US005272640A

United States Patent [19]

Wu

[11] Patent Number: 5,272,640

[45] Date of Patent: Dec. 21, 1993

[54] AUTOMATIC MAIL-PROCESSING DEVICE WITH FULL FUNCTIONS

[76] Inventor: Sheng J. Wu, 220, Berkley St., Saint Lambert, Montreal, Quebec, J4P 3E1, Canada

[21] Appl. No.: 967,580

[22] Filed: Oct. 28, 1992

Related U.S. Application Data

[63] Continuation of Ser. No. 570,023, Aug. 20, 1990, abandoned, which is a continuation-in-part of Ser. No. 536,496, Jun. 11, 1990, which is a continuation-in-part of Ser. No. 920,648, Oct. 20, 1986, Pat. No. 4,940,887.

[51] Int. Cl.[5] ..... G07B 17/02

[52] U.S. Cl. ..... 364/464.02; 364/464.03

[58] Field of Search ..... 177/25.15; 364/464.02, 364/464.03

[56] References Cited

U.S. PATENT DOCUMENTS

| | | | |
|---|---|---|---|
| 3,890,492 | 6/1975 | Manduley et al. | 364/464.03 |
| 4,286,325 | 8/1981 | Dlugos et al. | 364/464.03 |
| 4,376,981 | 3/1983 | Check, Jr. et al. | 364/464.02 X |
| 4,393,454 | 7/1983 | Soderberg | 364/464.02 X |
| 4,495,581 | 1/1985 | Piccione | 177/25.15 X |
| 4,635,205 | 1/1987 | Eckert, Jr. et al. | 364/464.02 |
| 4,797,832 | 1/1989 | Axelrod et al. | 364/464.02 X |
| 4,868,757 | 9/1989 | Gil | 364/464.03 |
| 4,908,770 | 3/1990 | Breault et al. | 364/464.02 |
| 4,923,022 | 5/1990 | Hsieh | 364/464.03 X |
| 4,940,887 | 7/1990 | Sheng-Jung | 364/464.03 X |

*Primary Examiner*—Edward R. Cosimano
*Attorney, Agent, or Firm*—Lalos & Keegan

[57] ABSTRACT

An automatic mail-processing device with full functions, which can be operated by only one postal clerk, and wherein by means of a microprocessor, all kinds of delivery types and additional service types such as registered special, insured, attested and express types of various individual letters or bulk mailings are included and functions of automatical weighing, postage calculation, charging, postage stamping (or postage note stamping), postage receipt printing, register receipt printing, and regular daily, weekly or monthly income list printing are performed.

22 Claims, 17 Drawing Sheets (1) 7424 : EUROPE/AFRICA/MIDDLE SOUTH AMERICA.
(2) 7432 : EUROPE/AFRICA/SOUTH AMERICA/MIDDLE NEAR EAST.
(3) 7463 : EUROPE/AFRICA/SOUTH AMERICA/MIDDLE NEAR EAST.

AUTOMATIC MAIL-PROCESSING DEVICE WITH FULL FUNCTIONS

This is a continuation of copending application Ser. No. 07/570,023 filed on Aug. 20, 1990 now abandoned, which is a continuation-in-part of copending application Ser. No. 07/536,496, filed Jun. 11, 1990, which is a continuation-in-part of application Ser. No. 920,648, filed Oct. 20, 1986, now U.S. Pat. No. 4,940,887.

BACKGROUND OF THE INVENTION

The present invention relates to an automatic mail-processing device with full functions, and more particularly to an automatic mail-processing device which can be operated by only one postal clerk to perform all delivery types and additional service types of all kinds of mails, and the functions of which include automatical weighing, postage calculation, charging, postage stamping, receipt printing, register receipt printing and regular daily, weekly, monthly income listing whereby the postal business can be practiced systematically, automatically, accurately and highly efficiently.

The mail-receiving and mail deliverying operations in current Post Office are quite complicated. They can be sorted according to their characters as follows:

(1) mail character: leer, printed matter, small packet, commercial document, small packet, electronic mail, etc.

(2) delivery area: domestic, international (further divided into various districts or countries).

(3) delivery type: air, sea/land, land/air, regular.

(4) service type: common, register, special, insure, declare, delivery, advice, attest, express, prompt delivery, etc.

(5) receiver/deliver amount: individual or bulk.

(6) charging manner: according to weight or number, also considering mail character, delivery area, delivery manner, service type, and receive/deliver amount to charge generally.

The above-mentioned various procedures are managed through respective counters wherein the weighing is practiced according to different standards, and the postage is calculated according to complex charge list, and therefore the equipments needed in these procedures are quite complicated and not so easily maintained. Moreover, the numberous procedures waste enormous labor and are apt to cause an uneven work distribution and low working efficiency and thereby errors occur frequently. Particularly the mailer always wastes a lot of time when waiting.

Furthermore, the postage stamps used in general post offices are transmitted to the postal counter after the following sequential complex procedures: design, printing, storing, delivery and receiving. These procedures are performed at quite high expense. Moreover, when mailing a mail, the mailer must go through weighing, postage calculation, buying the stamp, attaching the stamp to the mail, and then dropping the mail into the mail box, etc. The dispatched mail must thereafter be checked for overweight, postage due, and then stamped, sorted, etc. Considerable large work loading results therefrom. However, the aforesaid procedures have been adopted long since. Although the post administrations of various countries have tried to improve the defective operation, but nothing innovative is developed.

It is therefrom tried by the applicant to develop the present automatic mail-processing device to eliminate the aforesaid shortcomings existing in conventional mail-processing system.

SUMMARY OF THE INVENTION

It is a primary object of the present invention to provide an automatic intelligent mail-processing device with full functions. The operations thereof are completely computerized and adapted to cooperate with peripheral equipments such as printer, card reader/-writer and key board assembly, etc. Besides the mail receiving operation, the present device can print automatically the receipts in every managing stops and perform business statistics and listing to thoroughtly replace the current postal table operations and peripheral operations thereof and achieve an innovative mail-processing procedure.

It is a further object of the present invention to provide the above mail-processing device wherein the postage stamping operation and the postage calculation are both greatly improved and simplified, and the steel stamp required by securities is maintained and controlled by microprocessor programs.

It is still a further object of the present invention to provide the above mail-processing device wherein the standard mail, which occupies at least about 70% of total mails, can be weighed during conveyance automatically, and then sent to the postage stamping area for stamping, whereby the problem of discontinuity between weighing and stamping procedures existing in conventional mail-processing machine is overcome revolutionarily.

It is still a further object of the present invention to provide the above mail-processing device wherein in case that the device is disposed in a sub-post office or other business office, it can be controlled remotely or on line by remote host, and the data stored in each processing device can be transmitted to the remote host or control center of head post office for completely controlling the operation of each processing device. Therefore, the present device can be operated with least labor and at minimum expense.

It is still a further object of the present invention to provide the above mail-processing device wherein the functions thereof can be freely increased or decreased according to various market requirements, mail varieties, and service levers, etc., and moreover, the present device can be alternatively assembled within same spirit to satisfy various special market requirements.

The present invention can be best understood through the following description and accompanying drawings wherein:

DETAILED DESCRIPTION OF THE PREFERRED EMBODIMENTS

Figure 1A:
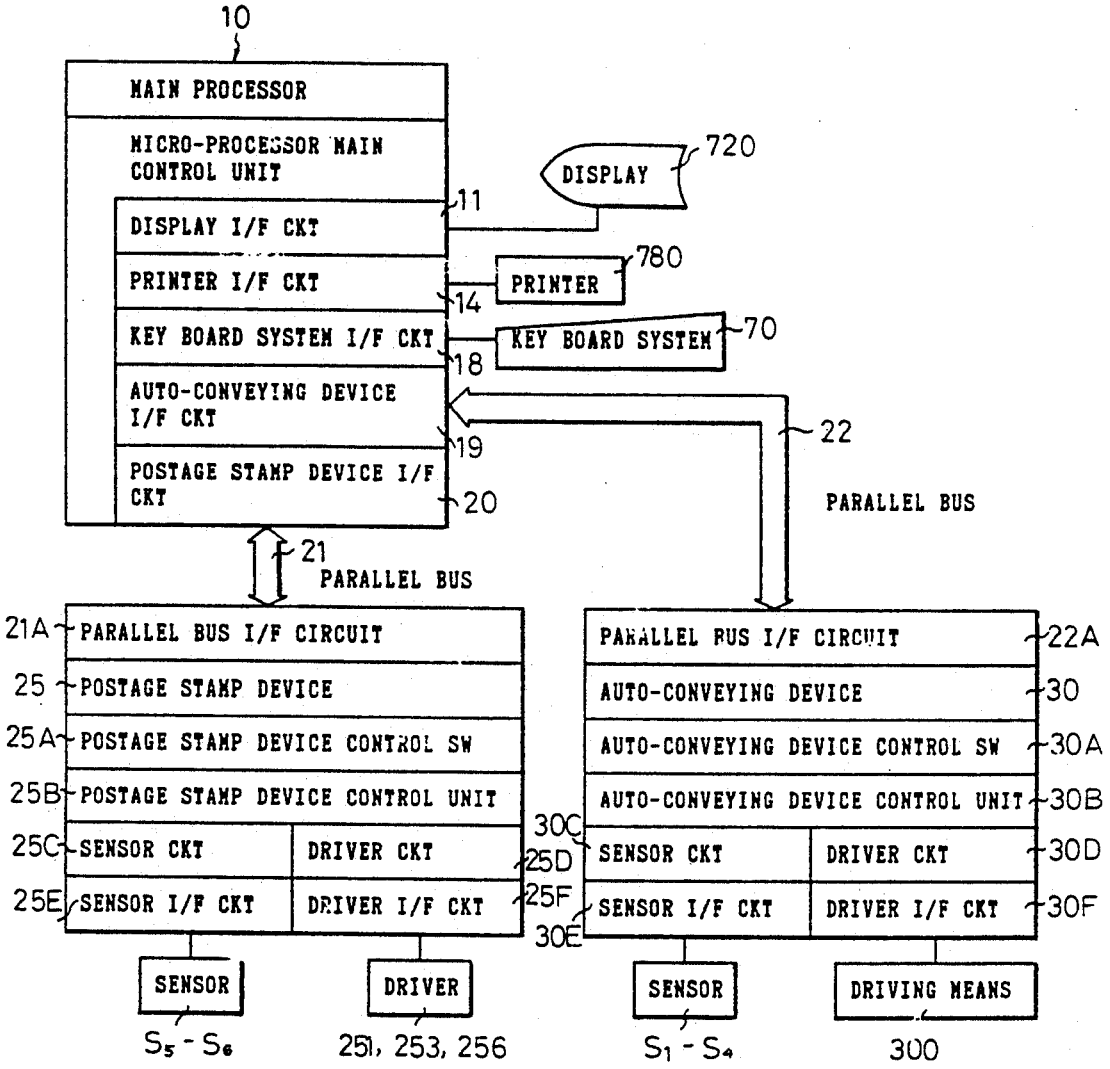
FIGS. 1A to 1D are system block diagrams of four embodiments of the present invention.

Referring to FIG. 1A, a first embodiment of the present automatic mail processing system includes a microprocessor 10, a display device 720, a printer 780, a keyboard system 70, an auto-conveying device 30 and a postage stamp device 25, wherein the microprocessor having a micro processor main control unit includes a display I/F (interface) circuit 11 controlling the display device 720, a printer I/F CKT (circuit) 14 commanding the printer 780 to work, a key board system I/F CKT 18 capable of receiving commands from key board system 70 and communicating therewith, an auto-conveying device I/F CKT 19 used to control auto-conveying device 30 and receive signals therefrom and communicate therewith, a parallel bus 22 related to and communicated with the auto-conveying device I/F CKT 19 and a parallel bus I/F CKT 22A, a postage stamp device I/F CKT 20 used to control auto-postage stamp device 25 and receive signals therefrom and communicate therewith, and a parallel bus 21 related to and communicated with the postage stamp device I/F CKT 20 and a parallel bus I/F CKT 21A. As shown in FIG. 1A, the postage stamp device 25 includes a postage stamp device control SW (switch) 25A, a postage stamp device control unit 25B, a sensor CKT 25C, a sensor I/F CKT 25E, a sensor S5, S6, a driver CKT 25D, a driver I/F CKT 25F and a driver 251, 253, 256, etc. While the auto-conveying device 30 includes an auto-conveying device control SW 30A, an auto-conveying device control unit 30B, a sensor CKT 30C, a sensor I/F CKT 30E, a sensors S1–S4, a driver CKT 30D, a driver I/F CKT 30F and a driver 300, wherein the auto-postage stamp device 25 transmits the signals obtained by sensors S5, S6 through the sensor I/F CKT 25E, sensor CKT 25C to auto-postage stamp device control unit 25B, auto-postage stamp device control SW 25A, and then the signals are converted into effective commands via the programs of the microprocessor and sent to the driver CKT 25D, driver I/F CKT 25F to command the drivers 251, 253, 256 to operate in accordance with the commands. While the auto-conveying device 30 also transmits the signals obtained by sensors S1–S4 through the sensor I/F CKT 30E, sensor CKT 30C to the auto-conveying device control unit 30B, auto-conveying device control SW 30A, and then the signals are converted into effective commands via the programs of the microprocessor and sent to the driver CKT 30D and driver I/F CKT 30F to command the driver 300 to operate according to the command.

Figure 1B:
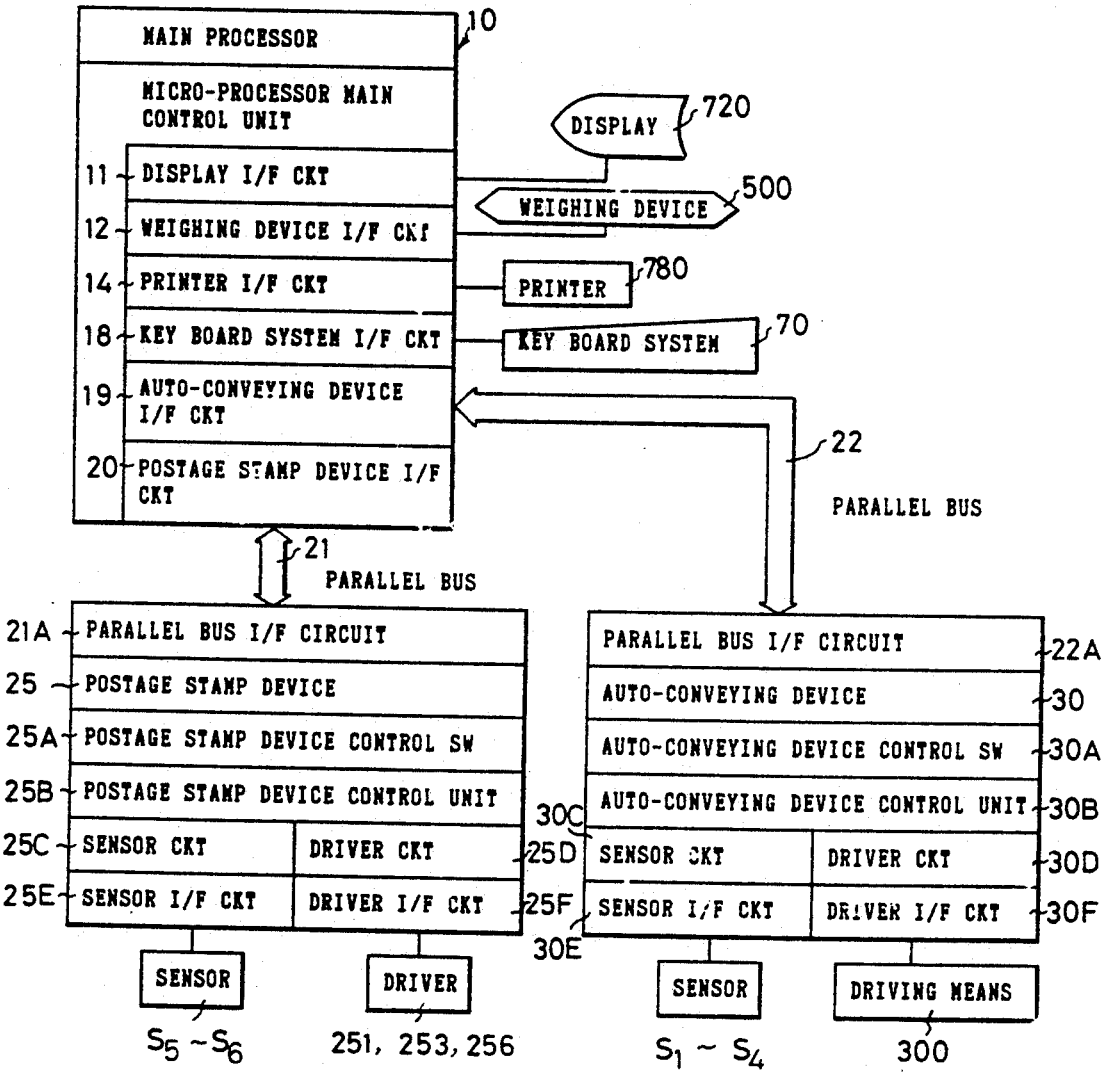

Further referring to FIG. 1B, a second embodiment of the present invention is shown. A weighing scale 500 is added to the system, and a weighing scale I/F CKT 12 is added to the microprocessor 10 for receiving signals from the weighing scale 500. The remaining parts are identical to the first embodiment and the description thereof is therefore omitted.

Figure 1C:
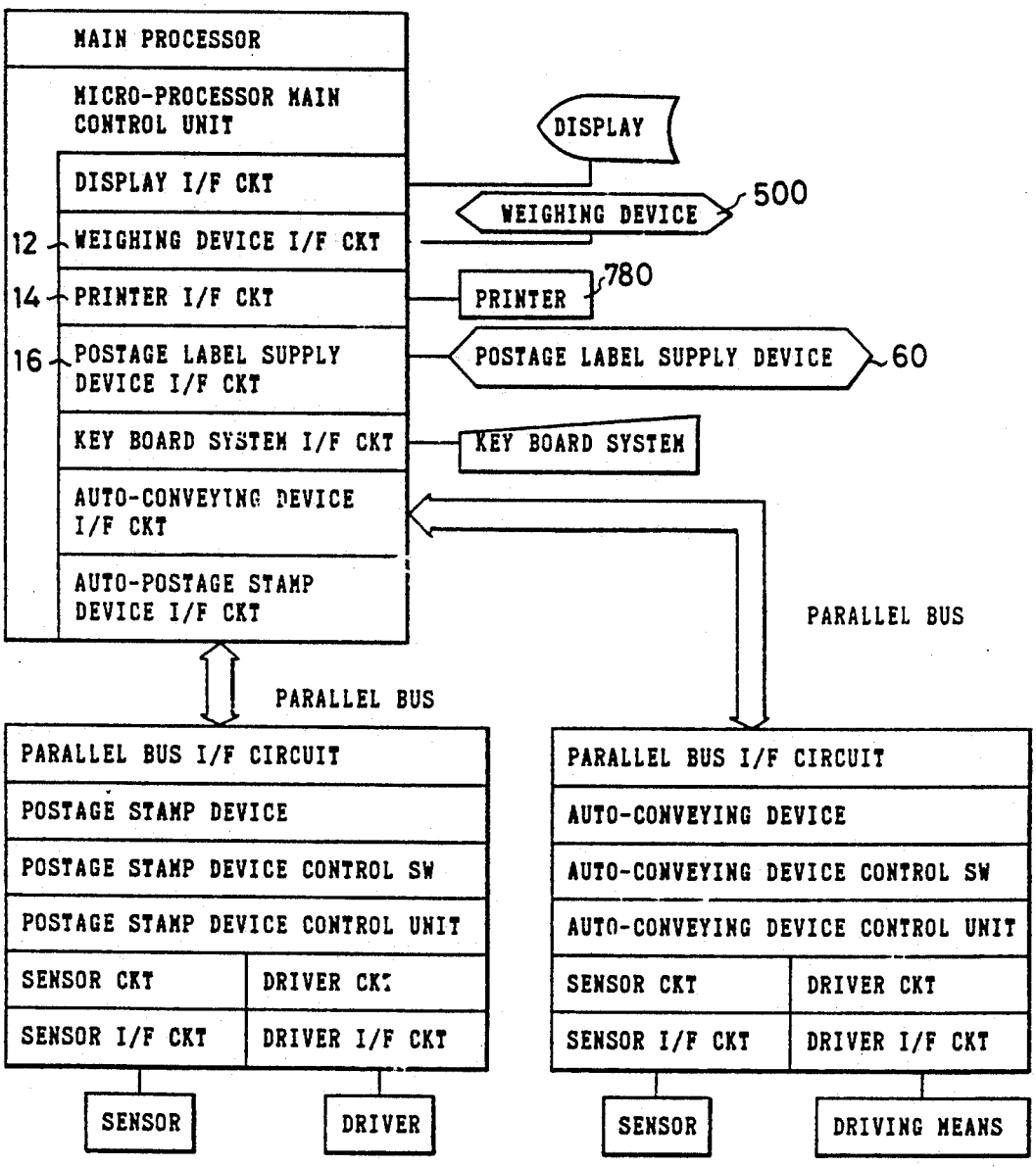

A third embodiment of the present invention is shown in FIG. 1C. A postage label supply device 60 and a postage label supply device I/F CKT 16 adapted to command the postage label supply device 60 and receive signals therefrom and communicate therewith are added to the second embodiment to form the third embodiment.

Figure 1D:
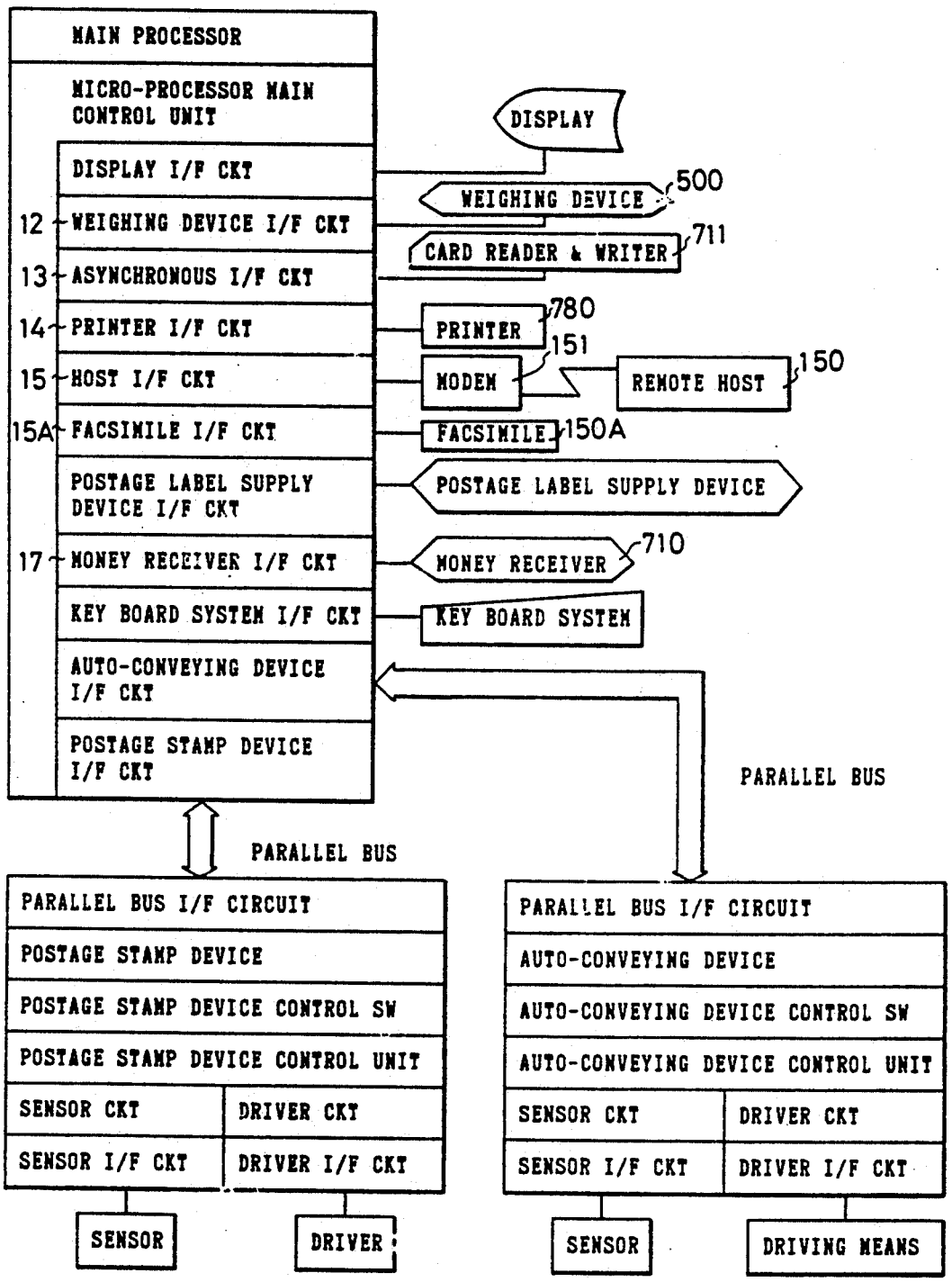

A fourth embodiment of the present invention is shown in FIG. 1D. The fourth embodiment is achieved by adding to the third embodiment a card reader/writer 711, a remote host 150 for controlling each mail-processing device, a facsimile 150A for sending electronic mail, a money receiver 710, an Asynchronous I/F CKT 13 capable of receiving signals from card reader/writer, controlling the same and communicating therewith, a host I/F CKT 15 capable of connecting to the remote host 150 via a modem 151 or communicating with the remote host 150 wirelessly, and a money receiver I/F CKT 17 capable of receiving signals from the money receiver 710 and controlling the same.

As set forth above, the display 720, weighing device 500, printer 780 and a facsimile 150A can be additionally operatively connected to said microprocessor respectively via the weighing device I/F circuit 12, the printer I/F circuit 14 and a facsimile I/F circuit 15A according to actual requirements, while the remote host 150, card reader/writer 711 and money receiver 710 can be removed in accordance with different situations. The facsimile 150A is well known in the art, and therefore a detailed description thereof is omitted.

Figure 2A:
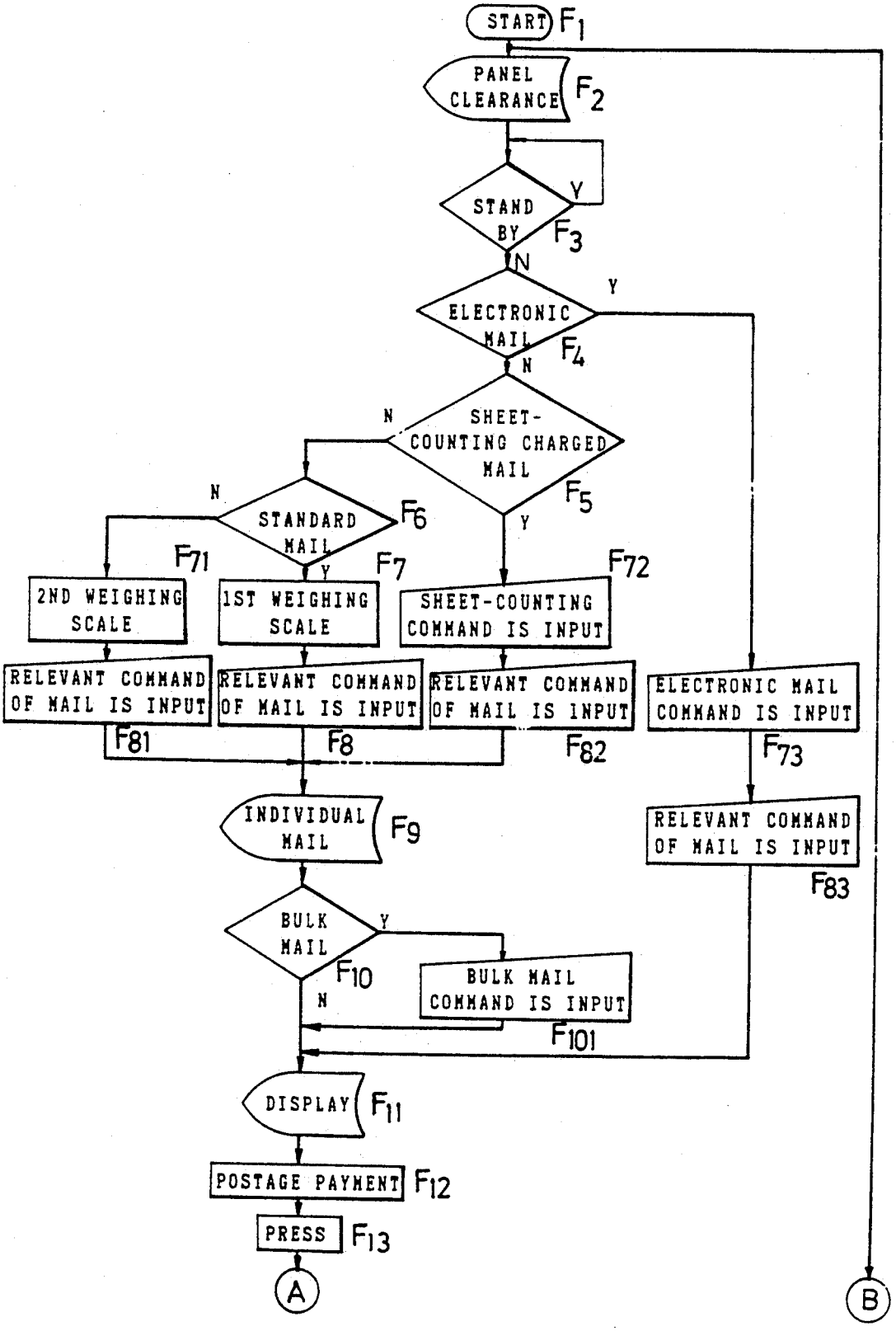
FIGS. 2A and 2B are flow charts of operation of the present invention.
Figure 2B:
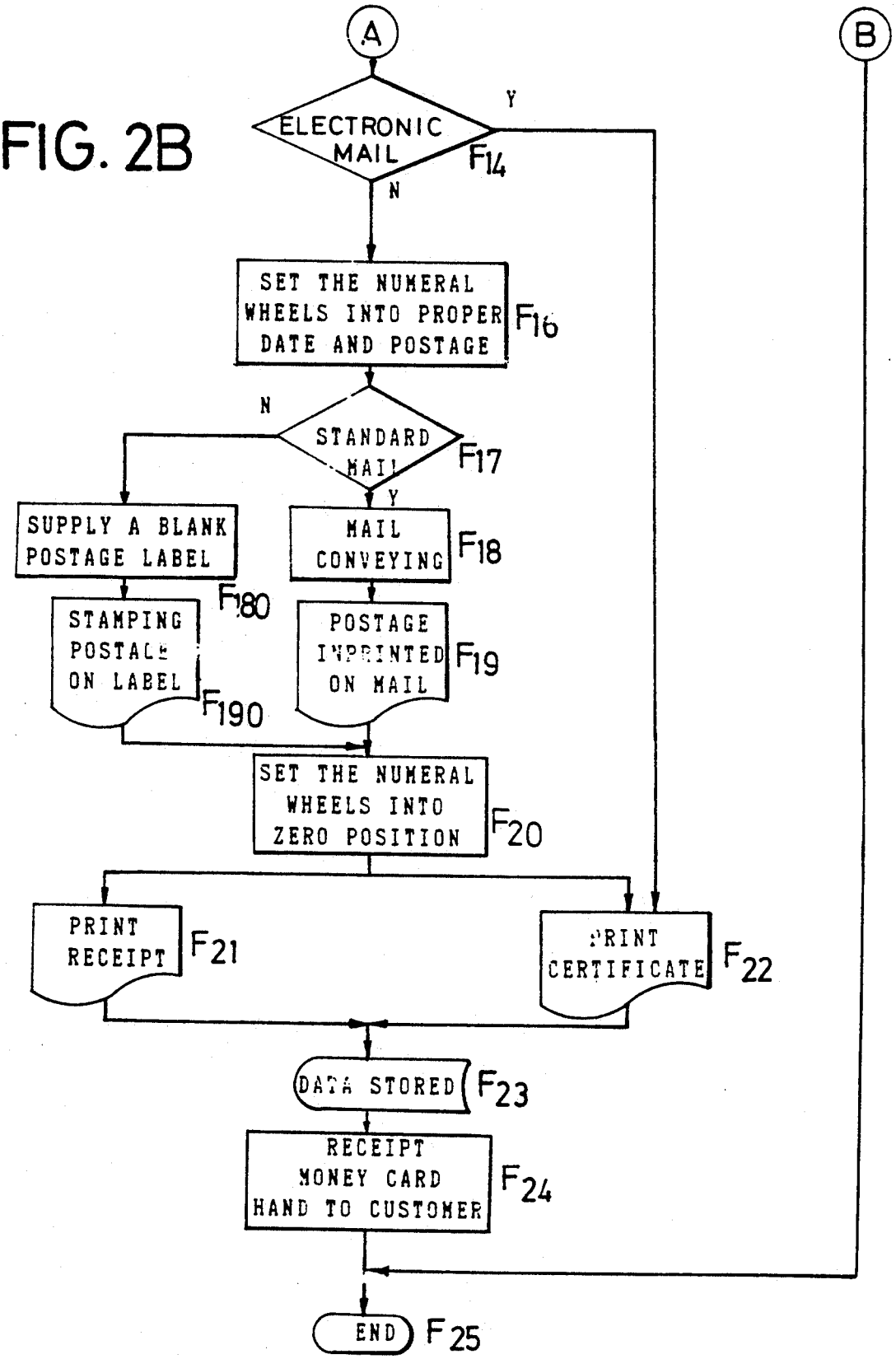

Please now refer to FIGS. 2A and 2B. The operation of one embodiment of the present invention is illustrated by a flow chart. The operation procedures of the present invention are generally divided into four types wherein the first thereof is the processing of weight-counting standard mail; the second is the processing of weight-counting non standard mail; the third is the processing of sheet-counting charged mail; the fourth is the processing of electronic mail. With respect to the weight-counting standard mail, the processing thereof starts from F1 and goes to panel clearance F2 and stand by F3, where it loops if stand by (Y) or continues to F4 if not (N) stand by. When going to electronic mail F4 and a negative signal is given, the procedure goes to sheet-counting charged mail F5 and then if a negative signal is given, the processing goes to standard mail F6. In F4, if a positive signal is given, the procedure goes to F73 for electronic mail command input. When a positive signal is given in F6 by means of pressing a "standard mail" key, the microprocessor 10 then commands the system to operate according to the preset "standard mail" procedure. The standard mail is thereby sent to a first weighing scale F7. The operator then inputs relevant informations of the standard mail (such as delivering manner, service division, register, or insured value, etc.) into the microprocessor 10, which thereafter calculates the postage according to these informations via preset programs. If a positive signal is given in bulk mail procedure F10, a bulk mail command must be input to enable the procedure to go to the bulk mail procedure F101. The total postage mail then be displayed on the display 720 in procedure F11.

In case of individual standard mail, the procedure will go directly from F9 to F11. After the postage payment procedure F12, all commands are checked for correction, and if so, the actuating key is pressed in procedure F13. At this time, the microprocessor will command the postage stamp device to automatically set the numeral wheels thereof into proper date and postage in procedure F16. When a positive signal is given in standard mail procedure F17, the mail is conveyed to the printing position in mail conveying procedure F18. In procedure F19, the postage is imprinted on the mail. (The mails can be sorted if necessary. This procedure is not shown in FIG. 2B.) Thereafter, the postage stamp device is zeroed in procedure F20. The printer will then print a receipt and certificate in procedures F21 and F22, respectively, and then the above relevant data are stored in procedure F23. Simultaneously, the receipt, money card and other documents are given to the customer in procedure F24 and the whole procedure ends in procedure F25.

According to the above procedure, in case of a non standard mail, the procedure will go from F6 to a second weighing scale procedure F71 and relevant commands are input according to identical manner in procedure F81. In procedure F9, the postage is calculated by microprocessor and the procedure goes from F10 to F17. Because of non standard mail, the microprocessor 10 will command the postage stamp device to supply a blank postage label and enter the label into printing position for imprinting from procedure F180 to procedure F190. The following procedure is the same procedure as the above-mentioned one and the description thereof is therefore omitted.

In case of sheet-counting charged mail, a position signal is given in procedure F5, and a sheet-counting command will be input in procedure F72. When relevant commands respecting the mail are input in procedure F82, the procedure will go from F9 to F13. In F14, if a negative signal is given, the procedure will go directly from F14 to F16 after postage payment, and then go to F17, F18, F19, F20 or F17, F180, F190, F20 according to standard mail or non standard mail procedure. The procedure goes finally to F21, F22 and ends after printing the receipt.

As to electronic mail, when a positive signal is given in procedure F4, and the electronic mail command is input in procedure F73, the commands of the mail can be input in procedure F83. Thereafter, when procedure goes from F11 to F13, since weighing is not necessary, the procedure will go directly from F14 to F22 to print the certificate after postage payment. The following procedure is identical to aforesaid one and the description thereof is therefore omitted.

Figure 3:
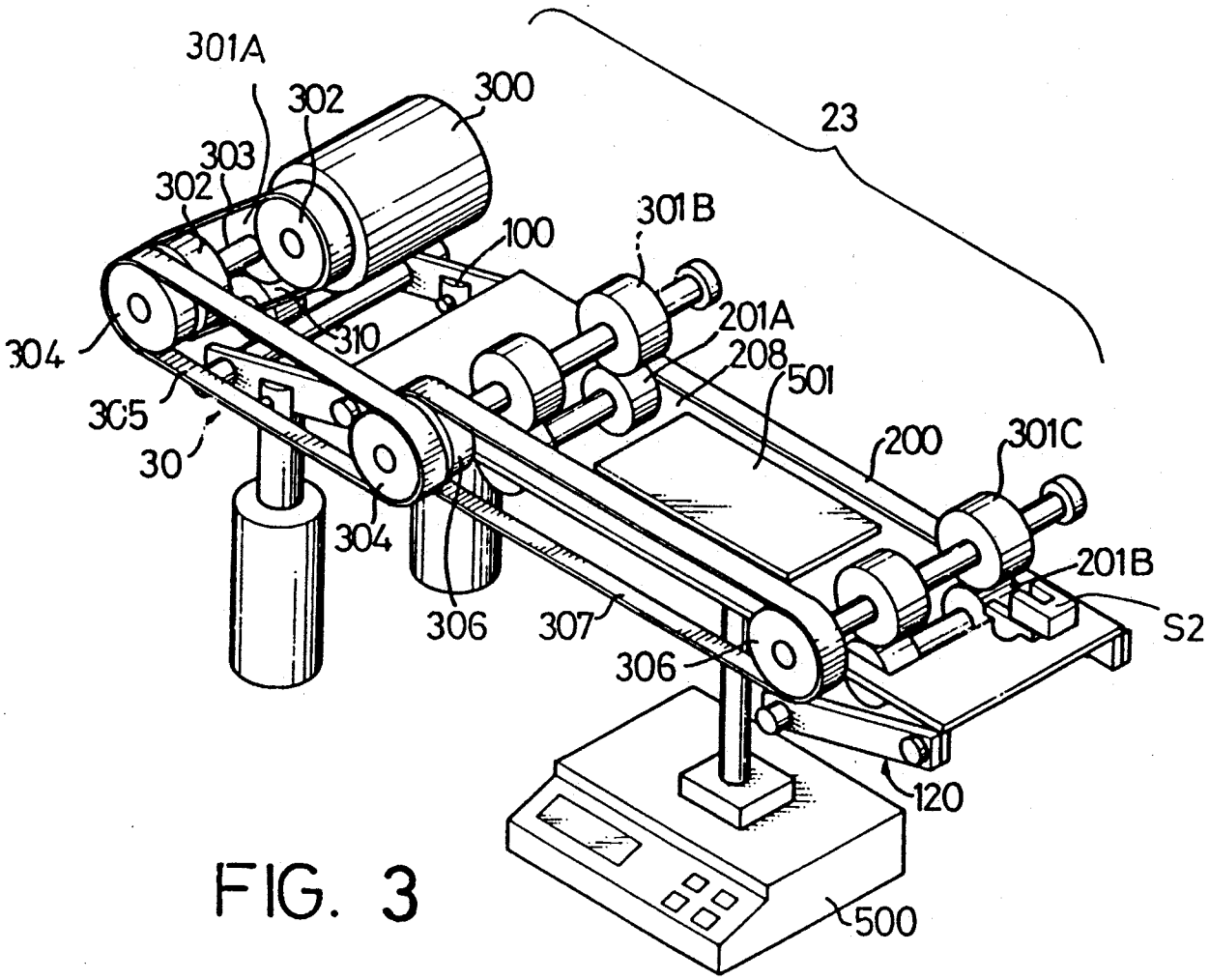
FIG. 3 is a perspective view of the conveying device and weighing device of the present invention.
Figure 4:
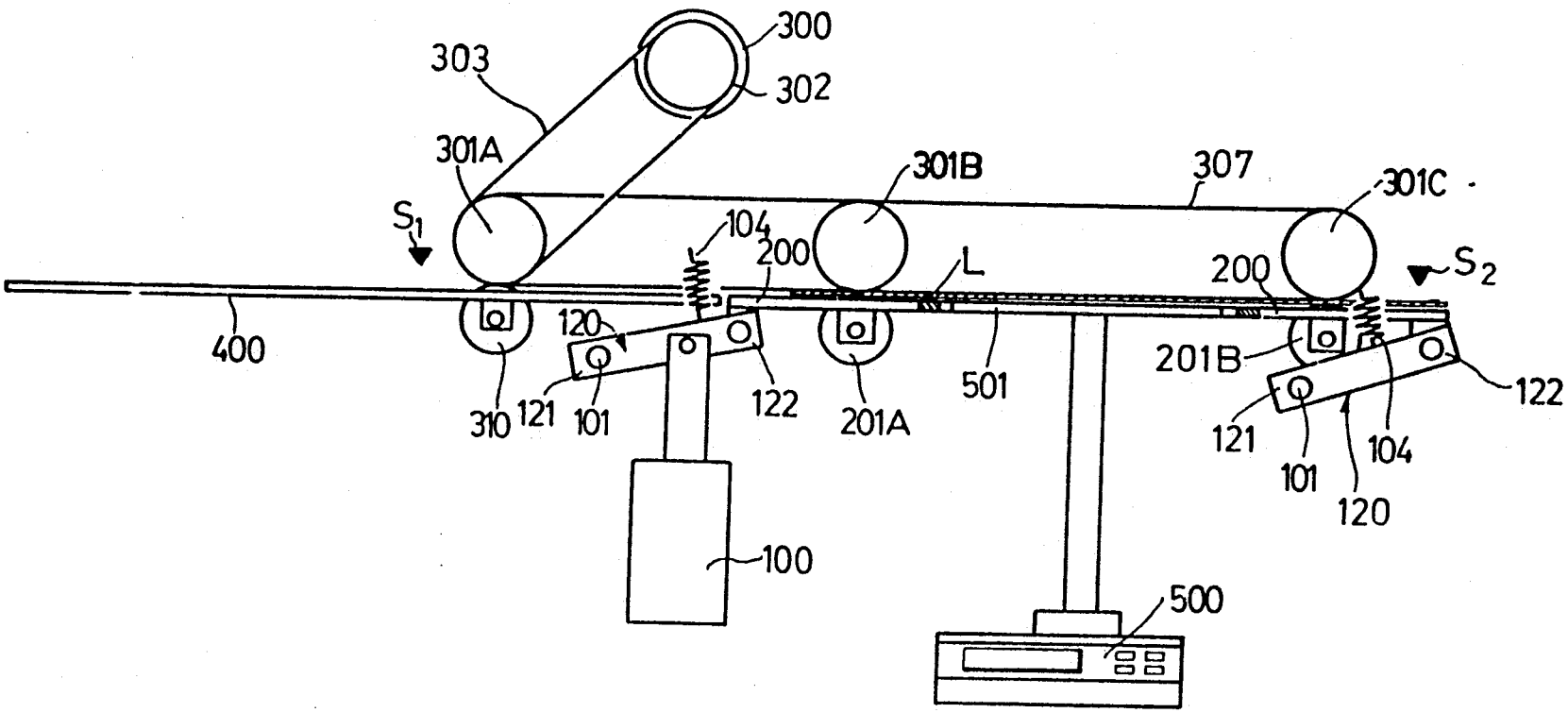
FIG. 4 is a plan view according to FIG. 3, showing a first operation state.
Figure 5:
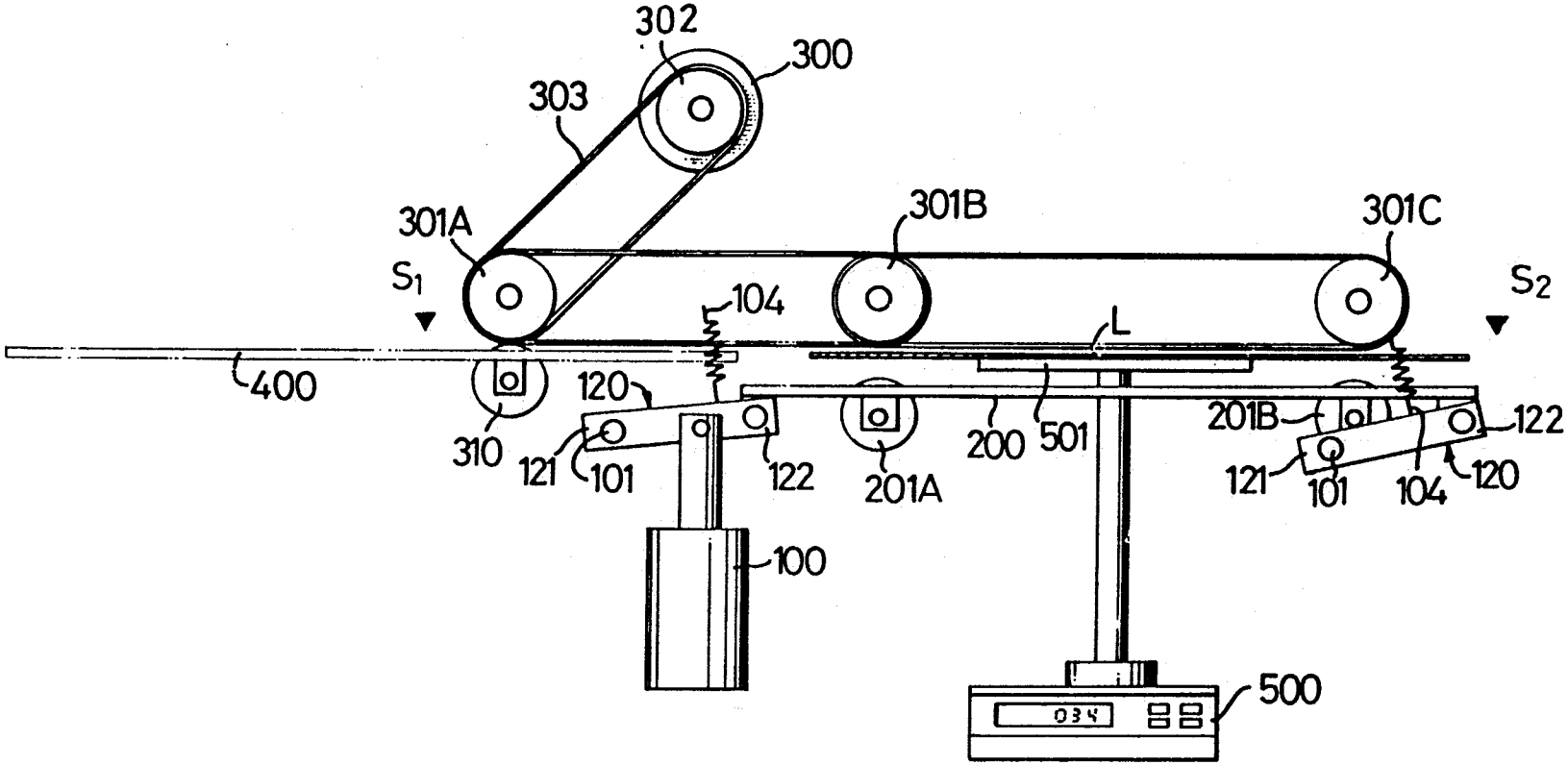
FIG. 5 is a plan view according to FIG. 3, showing a second operation state.

To easily understand the postal material-managing process of the present invention, two main portions thereof, i.e., automatic weighing device for conveyed postal material and automatic postage stamp device are described in detail as follows:

Referring to FIGS. 3 to 5, one embodiment of the automatic weighing device 23 for postal material in conveyance according to the present invention is illustrated. As shown in FIG. 3, the device 23 of the present invention comprises a conveying device 30, which includes a driving means 300, for example, a motor, a first conveying means 301A and a corresponding first idle wheel 310 thereof, a second conveying means 301B and a corresponding second idle wheel 201A, a third conveying means 301C and a corresponding third idle wheel 201B, a fixed stand 400, a movable stand 200 with a pair of rocking arms 120 (see FIGS. 4 and 5), and a weighing scale 500 located under the movable stand 200, and a first sensor S1 located before the first conveying means 301A (see FIG. 4) and a second sensor S2 located after the third conveying means 301C.

A novel aspect of the present invention is the movable stand 200 that includes a supporting stand with a rectangular opening 208 in the middle portion thereof. At both ends of the opening 208 there are disposed the second and third idle wheels 201A and 201B that are in cooperative relationship with the second and third conveying means 301B and 301C respectively to convey a standard mail L to be weighed.

Referring to FIG. 4. A movable end 122 of each of a pair of front and rear rocking arms 120 is pivotally connected at each end of the movable stand 200. The other end 121 of each rocking arm 120 is pivotally connected at a pivot 101. A pair of electromagnetic actuators 100, such as a solenoid, is connected to the middle portion of the front rocking arm 120. When the electromagnetic actuator 100 is activated, the movable end 122 is pulled down with the pivot 101 as a fulcrum. Since the moving stand 200 is attached to the movable ends 122 of both of the rocking arms 120, both movable ends 122 are actuated and descend simultaneously to move stand 200 to a lower horizontal plane. As best shown in FIG. 4, the second and third idle wheels 201A and 201B are connected to move with the movable stand 200 in vertical planes corresponding to the second and third conveying means 301B and 301C, respectively. The first conveying means 301A precedes the second conveying means 301B. The driving means 300, e.g. a stepping motor, drives the first, second and third conveying means. The first conveying means 301A is urged by a pair of first pulleys 302 (FIG. 3) and a first conveying belt 303 thereof. Referring again to FIG. 3, the second and third conveying means 301B, 301C are respectively urged by a pair of second pulleys 304, a second conveying belt 305, a pair of third pulleys 306, and a third conveying belt 307.

Disposed beneath the opening 208 of the movable stand 200 is the weighing scale 500. A weighing plate 501 of the weighing scale 500 is positioned above the main body of the weighing scale with its surface a little lower than the movable stand 200 so that the weighing plate 501 does not obstruct the conveyance of the article to be weighed.

The operation of the weighing device 23 of the present invention can best be understood by referring to FIGS. 3 through 5. Prior to reaching the first conveying means 301A and first idle wheel means 310, mail L comes in contact with the first sensor S1, such as photosensor, and the driving means 300 is actuated to convey mail L to a position to be weighed, as shown in FIGS. 4 (initial position) and 5 (weighing position). In the positions shown in FIGS. 4 and 5, the electromagnetic actuator 100 is not activated. Therefore, the movable ends 122 of the rocking arms 120, due to the force of the springs 104, urge the second and third idle wheels 201A, 201B upward and in close contact with the second and third conveying means 301B, 301C, whereby the mail L can be delivered onto the movable stand 200 as shown in FIG. 4.

When the mail L reaches the front edge of the second sensor S2, the second sensor S2 sends a sensor signal to actuator 100. The electromagnetic actuator 100 is thereby activated and the movable end 122 of the related rocking arm 120 is pulled down lowering movable stand 200 and the movable end of the other rocking arm. The mail L to be weighed is then seated on the weighing plate 501 of the weighing scale 500, as illustrated in FIG. 5. The weighing scale can weigh the mail L, and display the result on the display means of the weighing scale 500 via microprocessor 10 or send out a signal to perform some other control functions.

After a pre-set time period following measurement of the object's weight, the electromagnetic actuator 100 will be deactivated, and both rocking arms 120 are drawn back by the force of the springs 104 and the movable stand 200 is restored to its initial position. The mail L, having been weighed, is again held between the second and third idle wheels 201A, 201B and the second and third conveying means 301B, 301C, and thus continues to be conveyed into digital mark-printer 25.

It should be emphasized that by using this invention the mail L is weighed automatically in conveyance and in weighing position, the movable stand 200 is indicated to descend, preventing the mail L from contacting other portions and the result can be transmitted to a computer for analysis via the weighing device interface circuit 12. After weighing, the movable stand 200 automatically returns to its home position.

Figure 6:
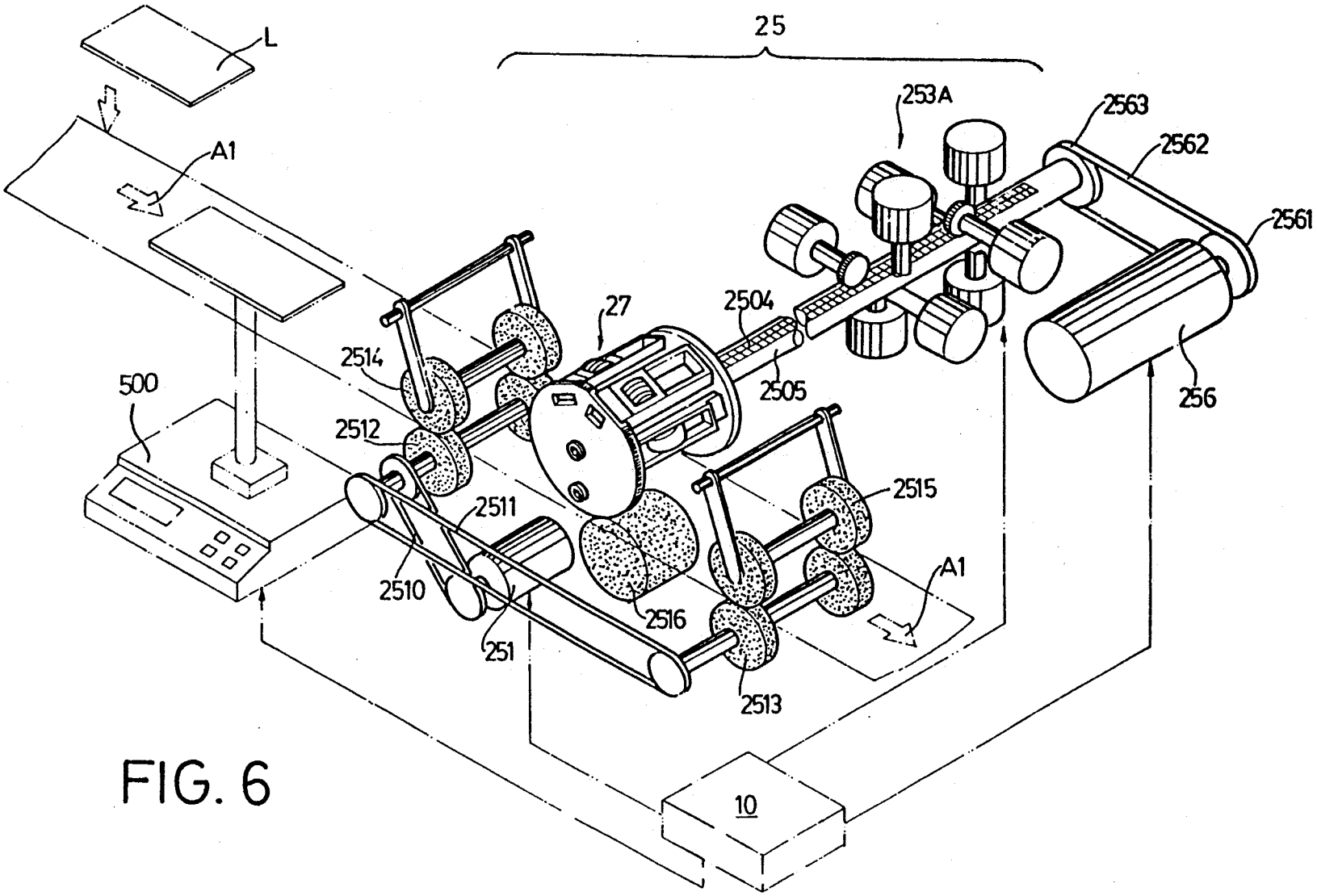
FIG. 6 is a perspective view of the digital mark-printer assembly of the present invention.
Figure 7:
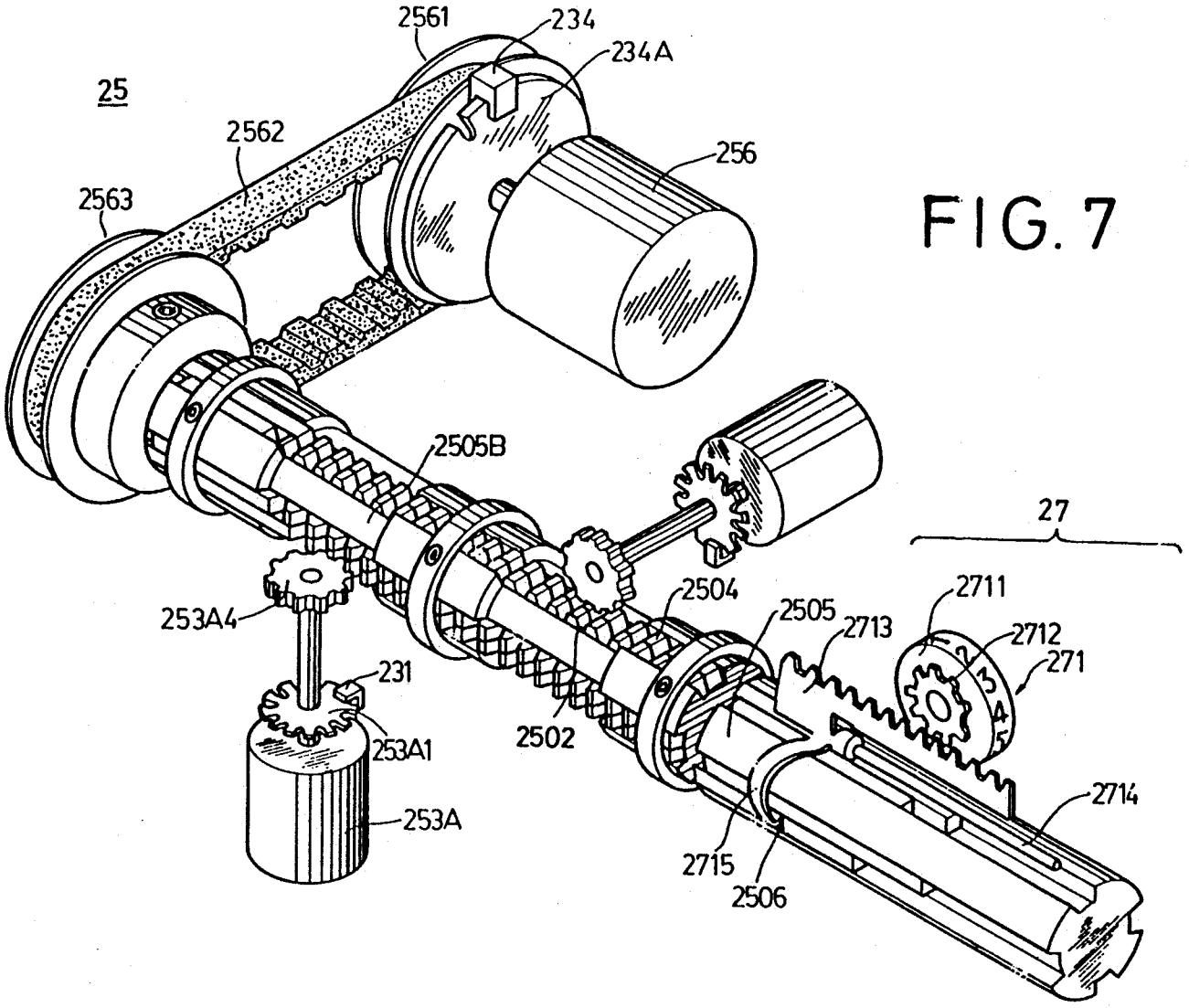
FIG. 7 is a perspective view of the main shaft and numeral wheel, illustrating the operation thereof.
Figure 8:
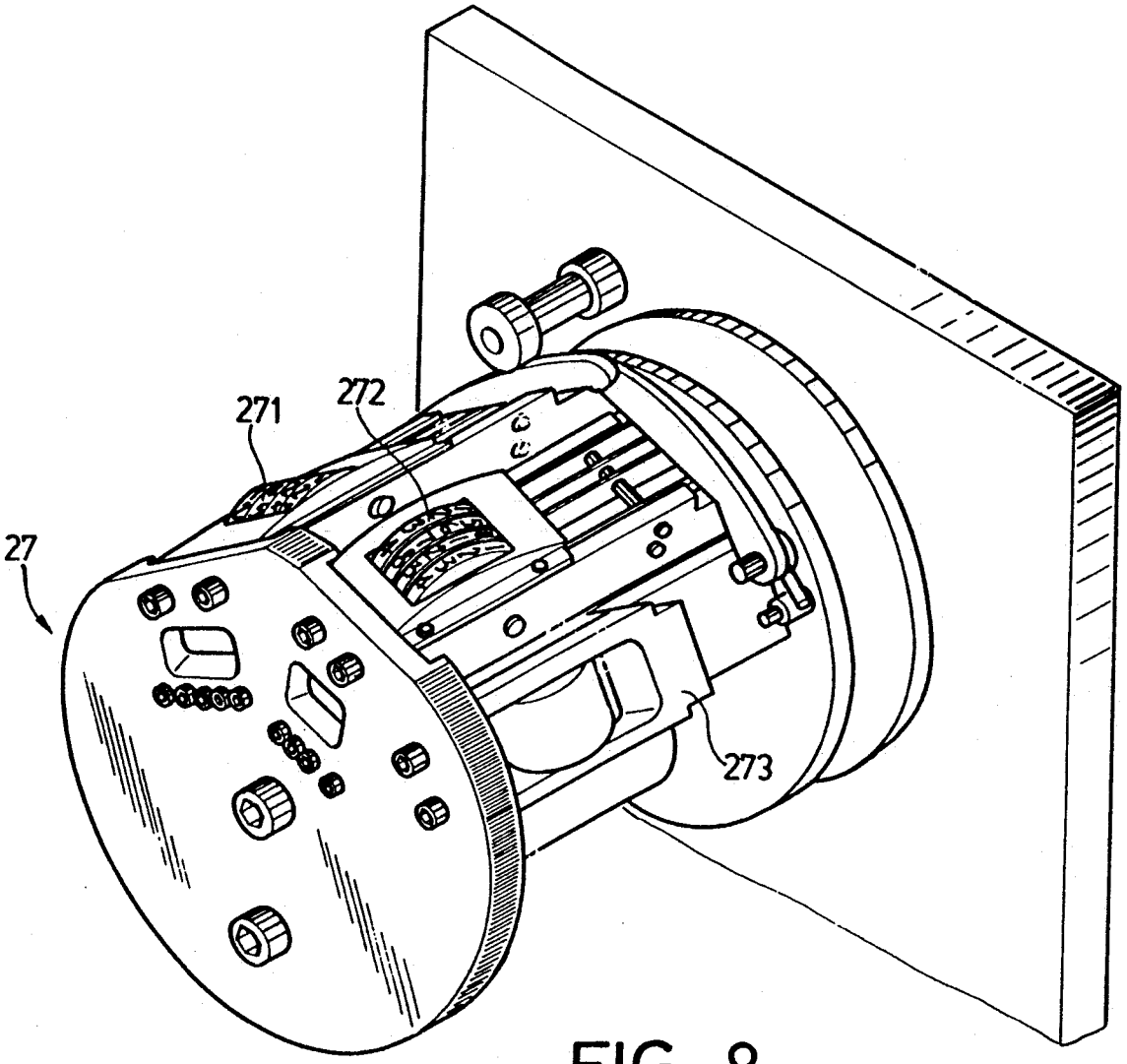
FIG. 8 is an enlarged perspective view of the printing head of the present invention.

Turning now to FIGS. 6 to 9, an embodiment of the postage stamp device 25 of this invention is shown. The printer 25 includes a conveying system and a postmark printing system wherein the conveying system is arranged above and below a conveying reference surface A1, including a main driving means of the conveying system, for example, a first stepper motor 251, driving a first roller 2512 and a second roller 2513 through timing belts 2510 and 2511 respectively, as shown in FIG. 6. Referring to FIG. 6, there are installed an idle roller 2514 with a stretching spring above the first roller 2512 and an idle roller 2515 above the second roller 2513. The post mark printing system is shown in FIGS. 6 and 7, including a main shaft driving means 256 e.g. a second stepper motor 256, pulleys 2561, 2563, a timing belt 2562, a main shaft 2505, on which a plurality of second racks 2504 are slidably mounted, a plurality of stepper motors 253A, . . . 253H for driving their respective numeral wheels 271, 272 through their respective related gears means 253A4 . . . 253H4, ink-printing means 40, a printing head 27, and an idle roller 2516 thereof (see FIGS. 6, to 9). The printing head 27, as seen in FIG. 8, includes a postmark wheel means 271 for imprinting postage, a postmark wheel means 272 for imprinting accepted date, a graphical postmark means 273 for imprinting advertising marks.

Referring to FIG. 7, the postmark wheel means of postage 271 further comprises a numeral wheel 2711, a gear 2712 attached therewith, a first rack 2713 engaged with the gear 2712, a guiding bar 2714 for a first rack 2713 to move thereon, and a hooking arm 2715. The lower end of the hooking arm is secured to a recess 2506 of a second rack 2504. In order to restore the main shaft 2505 to its home position after the completion of postmarking, an encoder 234A and a main driver sensor 234 are disposed near the driving portion of the second stepper motor 256. Similarly, in order to assure that the stepper motor 253A properly drives the corresponding character wheel 2711, an encoder 253A1 and a first wheel driver sensor 231 are disposed thereon.

Figure 9:
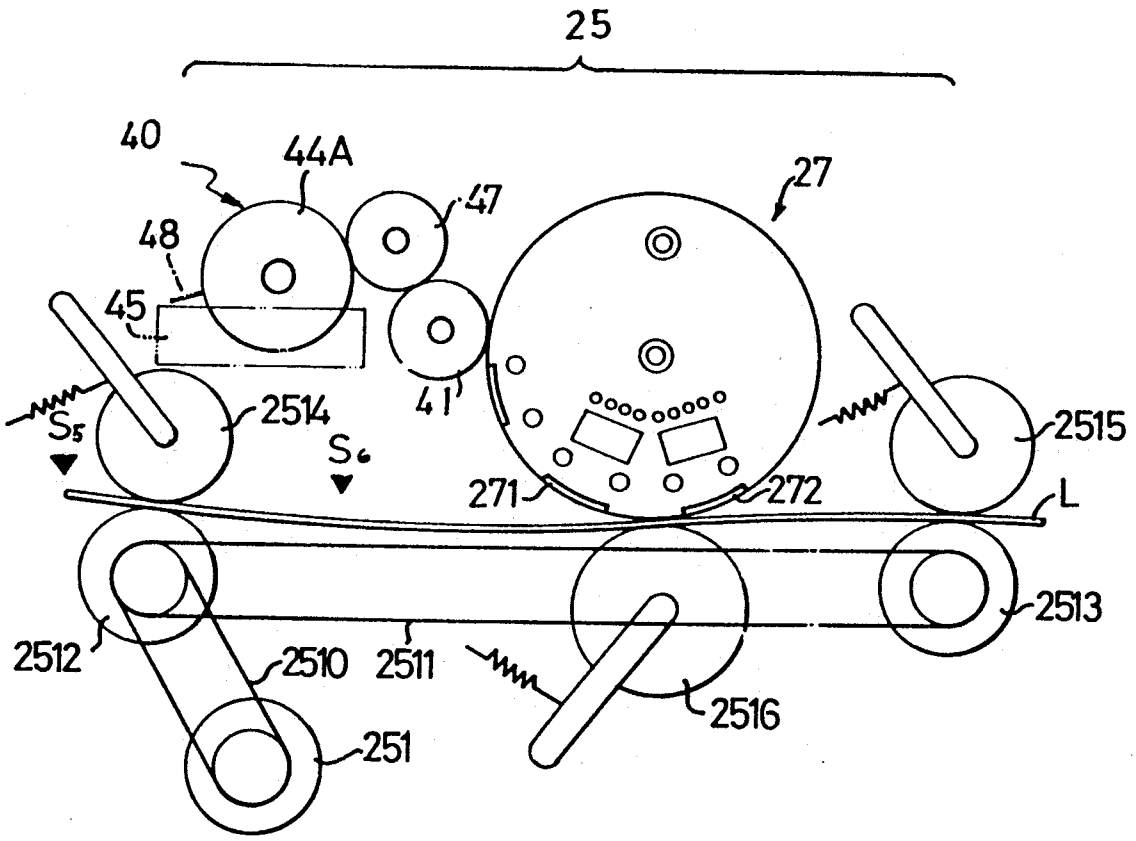
FIG. 9 is a side plan view of the digital mark-printer assembly of the present invention.

Prior to the entering of postal material into the conveying system, the printing head 27 is zeroed to its home position (not shown) wherein the motor 251 is the prime driving source of the conveying system. As shown in FIG. 9, disposed between the first roller 2512 and printing head 27 is a sensor S6 whereby after a postal material L passes through the sensor S6, the processor 10 will actuate the printing head 27. Below the printing head 27 is a third idle wheel 2516 with stretching spring in order that the postal material L have a close contact with the numeral wheel 271 of the printing head 27, as shown in FIG. 9.

As to the inking to be applied to the numeral wheel 271, it will be carried out by the printing ink means 40, as shown in FIG. 9. The ink means 40 includes an ink tank 45, a first roller 44A, a second roller 47, a third roller 41 and an adjusting means 48. The ink means 40 pertains to prior art and the description thereof is therefore omitted herein.

As can be seen in FIG. 9, when the postal material L is forwarded to be printed by the printing head 27, due to the spring effect of the first, second and third idle wheels 2514, 2515, 2516 the printing effect is equally excellent regardless of the thinkness of the printed postal material. This should be considered as an advantage of this invention over prior art.

The disclosure going thus far is made only with respect to a printing head with one numeral wheel, in practical operation, however, the device works with four numeral wheels or more than four numeral wheels arranged as two or more than two parallel sets, wherein one set functions as date numeral wheel, the other as postal charge numeral wheel, as shown in FIG. 8. Various arrangement between the stepper motors 253A–253F and their related second racks 2504A–2504F for each set of character wheels can be arranged easily. As can be understood, more character wheels mentioned above can be arranged in accordance with the need.

It has to be pointed out that a relatively smaller diameter portion 2505B of the main shaft 2505 of the printing head is in alignment with that where the driving gear 253A4 is located, as shown in FIG. 7. It will be seen from the drawing, the outer perimeter of the relatively smaller diameter portion 2505B, just comes flush with the dented base 2502 of the second rack 2504, so that after respective stepper motors 253A–253N are located at their proper positions and the main shaft 2505 of the printing head rotates, the second racks 2504 and the relatively smaller diameter portions 2505B can slip through the driving gear 253A4. In other words, the second rack 2504 for driving the character wheels of the printing head 27 can slide axially along the main shaft 2505, and also can rotate together with the main shaft 2505 after reaching its proper position, thus smoothing the work of the printing head 27 and reducing the very complicated machanism as needed in the cases of prior art work. This should also be concluded as one of the most important feature of this invention.

Figure 10:
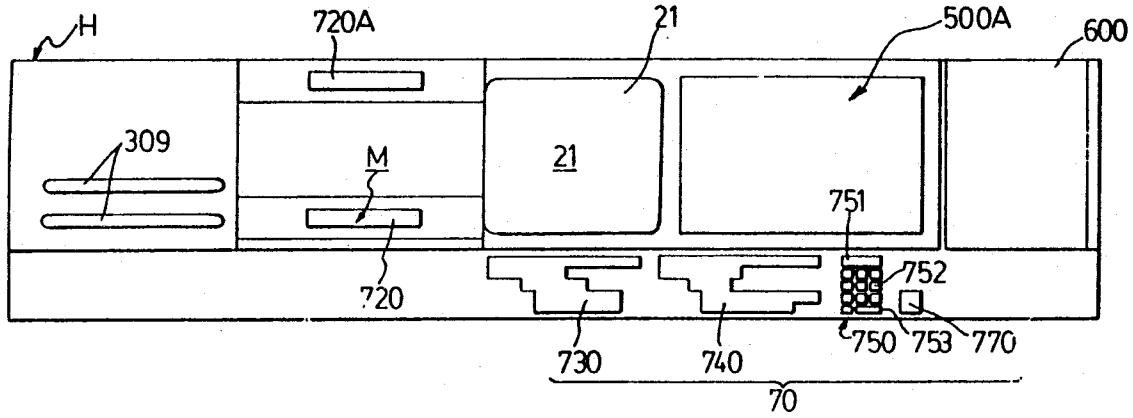
FIG. 10 is a overall top plan view of an embodiment of the present invention.
Figure 12:
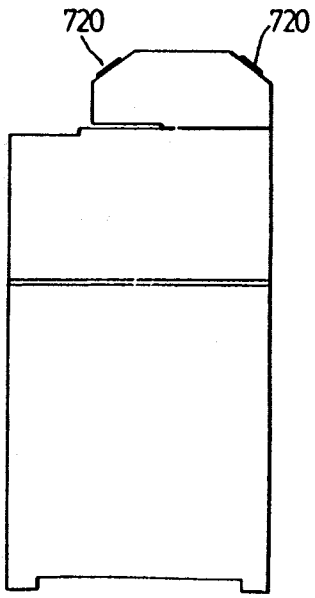
FIG. 12 is a side plan view according to FIG. 10.
Figure 11:
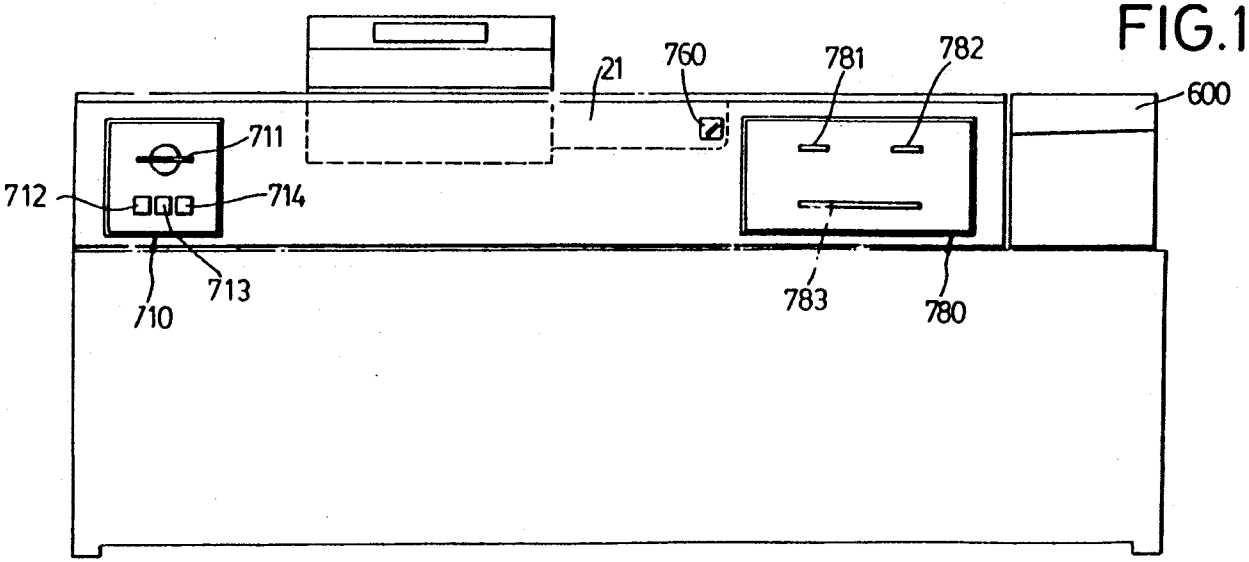
FIG. 11 is a front plan view according to FIG. 10.

To further understand the present invention, the automatic mail-processing system thereof is described as a whole as follows:

Please refer to FIGS. 10 to 12, which illustrate the appearance of the present invention. The front portion of the main body H of the automatic mail-processing system is faced to the postal clerks, while the rear portion thereof is faced to the customers normally. A guide rail 309 for bulk standard mail is disposed on the left front portion of the main body H. On the right side of the guide rail 309 is disposed a mechanism center M. Above the mechanism center M is located a first display device 720, and after the center M is located a second display device 720A. The mechanism center M includes the automatic conveying device 30, the first weighing scale 500 and settable automatic postage stamp device 25. On the right side of the mechanism center is disposed a collecting tank 21 for collecting processed postage label and bulk mails. Adjacent to the tank 21 is disposed the second weighing scale 500A. The weighing scales of the present invention are electronic weighing scales applying load cells as weight sensors. The second weight values are converted and displayed on the first and second display devices 720, 720A via the weighing scale I/F CKT 12 and microporcessor 10. To reach the object of communication between postal clerks and customers, the two display devices 720, 720A are disposed respectively on the front and back sides of the mechanism center to show the data about mail weight, postage calculation, postage payment, and other inner state indications (such as insufficient ink, lack of postage label, over weight, etc.) on both the first and second display devices 720, 720A.

As shown in FIG. 10, a key board system 70 is located on the front upper right portion of the main body, including domestic mail command input key board 730, international mail command input key board 740, bulk mail command input key board 750 and actuating key 770. On the front left portion of the main body is disposed the money receiver 710 including the card reader/writer 711, holding key 712, accumulating key 713 and cash key 714. On the front right portion of the main body is disposed the printer assembly 780 including receipt printers 782, 781, finacial list printer 783, etc. A power switch 760 is located on the left side of the printer assembly 780 to control the operation power of the present invention. Furthermore, a facsimile 600 is located at the right end portion of the main body for transmission of the electronic mails.

Figure 13:
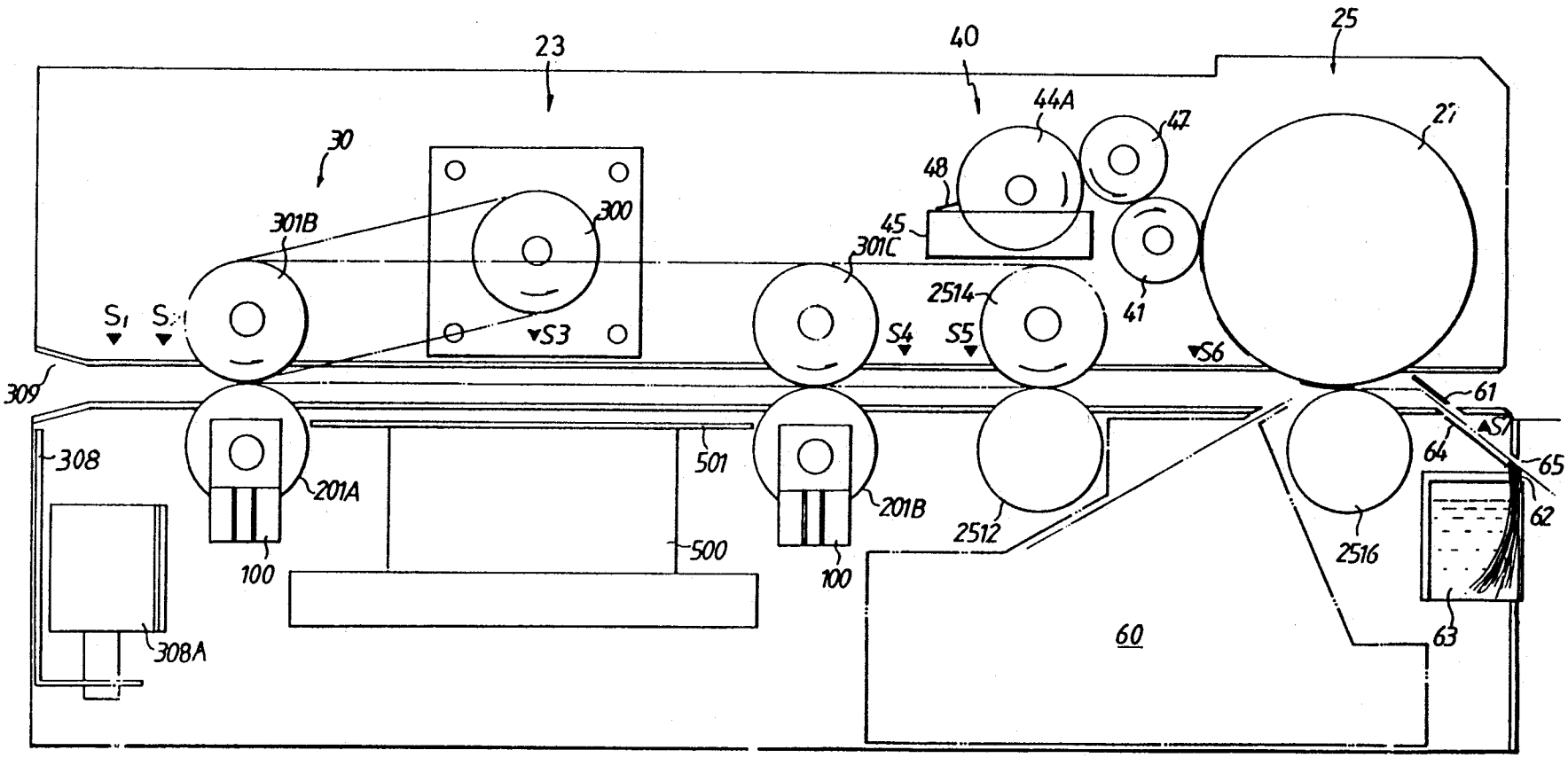
FIG. 13 is an enlarged view of the mechanism center according to FIG. 10.

Please now refer to FIG. 13, which illustrates the mechanism center M of the present invention. The mechanism center M essentially includes the automatic weighing device 23 and automatic postage stamp device 25, which have been described in preceding paragraph.

It should be noted that to prevent mails with abnormal length from affecting the normal operation of the present invention, a set of sensors S1 to S5 are provided whereby when a mail enters the system and is sensed by sensor S1, and the driver 300 consequently rotates to convey the mail forward, if sensor S2 senses the mail while sensor S3 does not sense, it indicates a too short mail, then the driver 300 will reversely rotate to reject the mail. Moreover, when sensor S5 senses the mail while sensor S1 remains in sensing condition, a too long mail is indicated and the driver 300 also reversely rotates to reject the mail. Therefore, mails not meet length regulation will be removed in advance. This arrangement is a characteristic of the present invention.

As shown in FIG. 13, this embodiment of the present invention is generally identical to the embodiment shown in FIGS. 3 to 9. However, the first conveying means 301A, first idle wheel 310 thereof, first pulley 302 and second pulley 304 are omitted in this embodiment, and a direct driving manner is applied therein. While in the automatic postage stamp device, the second roller 2513 and second idle roller 2515 are omitted, and the driver 300 of the automatic weighing device is alternatively located between the second and third rollers 301B, 301C to simultaneously drive the rollers 2514, 2512 for simplifying the driving mechanism. Additionally, a gate 308 is disposed at entrance 309 of the mechanism center M to prevent processed mails from interference of successive mails. The ink device 40 of the preceding embodiment is of pump type, but is of roller type in this embodiment. Furthermore, in this embodiment, to apply postage label to the non standard mail instead of direct postage stamp, a blank postage label supplying device 60 is disposed between the idle wheel 2516 and first roller 2512, and a movable guider 61 and brush member 62 are arranged at the exit of the printing head 27. Below the brush member 62 is disposed a water tank 63. When applying water to the back of postage label for attaching the same to the mail, the movable guider 61 can be pressed down manually (as shown in FIG. 13) or be controlled electromagnetically and synchronized with supplying device 60 whereby the postage label with postage stamp can be guided through a guide channel 64 when the guider 61 is pressed downward to be brushed by the brush member 62 and pass through an exit 65 to go into a collecting tank 21 as mentioned above.

Please now further refer to FIGS. 10, 11, 14 and 15. The key board system 70 of the present invention is arranged on the front right surface of the main body, serving as the operation controlling center of the present invention. The operation command input, state display, and the final receipt and list printing are all accomplished via the key board system. The key board system 70 includes primarily the money receiver 710, domestic mail command input key board 730, international mail command input key board 740, bulk mail amount command input key board 750, power switch 760, actuating key 770 and printer assembly 780. The structures and functions thereof are described as follows:

1. The money receiver 710, as shown in FIG. 11, includes the card reader/writer 711, holding key 712, accumulating key 713, and cash key 714 four components, wherein the card reader/writer 711 is a conventional device, which can read the balance amount of money on the money card and subtract the postage therefrom and then write down the new rest value. During this procedure, the relevant data are processed by microprocessor via RS232 interface and displayed on display device 720, 720A. Moreove, the income amount signal is transmitted to printer assembly 780 via microprocessor, serving as the basis for single mail receipt and list printing. If multiple mails are mailed at a time, and the mailer requires that all postages be printed on one receipt, he can press the accumulating key 713, whereby the microprocessor will receive this command and print the accumulated postage on one receipt. For example, when a first money card can not totally pay the needed money and a second money card is required to pay the rest money, the holding key 713 can be pressed after first money card payment. If the rest money is paid by cash or at a time, the cash key 714 can be pressed after cash payment.

According to the above arrangement, the money receiver 710 of the present invention is operated utterly by microprocessor and all income varieties can be listed by printer 782.

Figure 14:
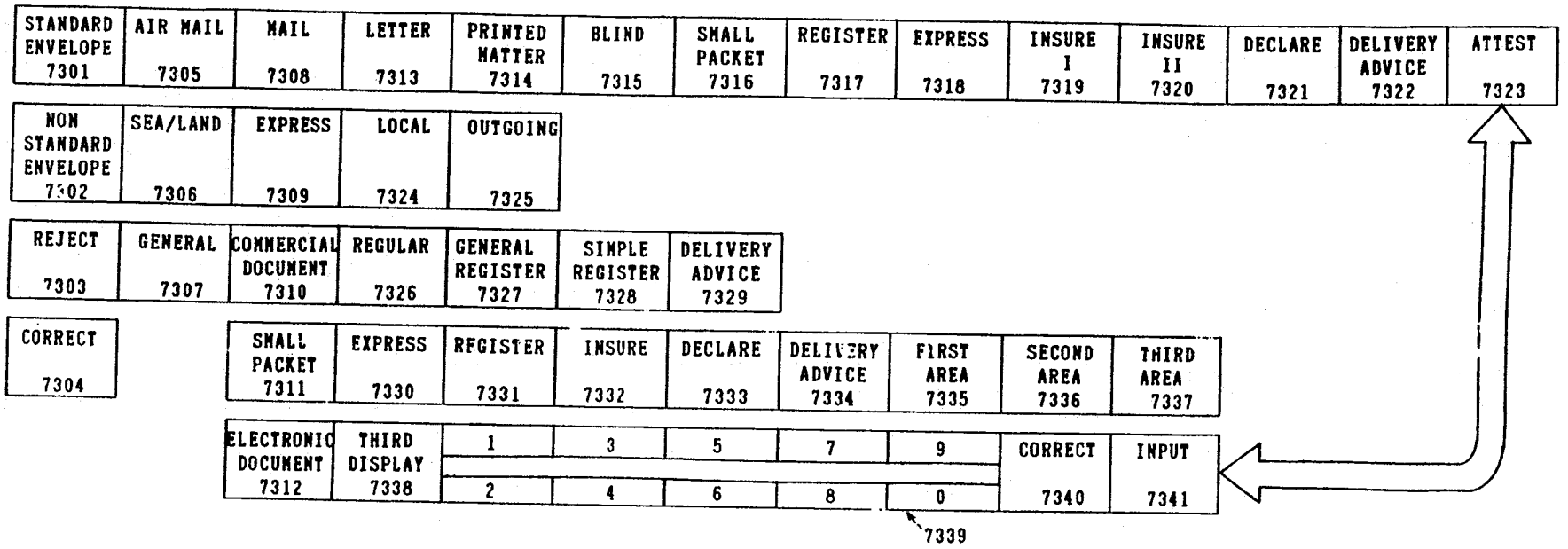
FIG. 14 shows the domestic key board arrangement according to FIG. 10.

2. The domestic mail key board 730, as shown in FIG. 14, includes command input of all kinds of domestic mails, such as mail size sorting key 7301, selecting key 7302, rejecting key 7303 and correcting key 7304. If the operation is incorrect, the correcting key 7304 can be pressed to restart the operation. The keys 7305 to 7307 are mail delivery type selecting keys and keys 7308 to 7312 are mail rough sorting keys including mail key 7308, express key 7309, commercial document key 7310, small package key 7311 and electronic document key 7312, etc. Keys 7313 to 7316 are fine sorting keys of mail key 7308, including letter key 7313, printing key 7314, blindness key 7315 and small packet key 7316. While keys 7317 to 7323 are service division keys for mail key 7308, including register key 7317, express key 7318, insure keys I and II 7319, 7320, declare key 7321, delivery advice key 7322, and attest key 7323. Keys 7324, 7325 are local/outgoing postage calculation sorting keys for express key 7309, and keys 7326 to 7329 are service division keys for commercial document key 7310, including regular key 7326, general register key 7327, simple register key 7328 and delivery advice key 7329, etc. Keys 7330 to 7337 are delivery area/service division keys for small package key 7311, including express key 7330, register key 7331, insure key 7332, declare 7333 and delivery advice key 7334, etc. Keys 7335 to 7337 are first area, second area, and third area keys according to delivery area division. While keys 7338 to 7341 are key group for electronic mail key 7312 and attest mail key 7323. Since these two mails are sheet-counting charged mail, therefore they are operated by the following keys, i.e., a first numeral key group 7339, correcting key 7340 and input key 7341, and the result thereof are displayed on a third display device 7338 for operator's checking. For example, when operating, if the sheet number of the mail is input via one of the ten numeral keys of the numeral key group 7339, the data will be displayed on the third display device 7338. After identified visually, the input key 7341 is then pressed. If an error is found, the correcting key 7340 then is depressed to restart the operation. The sheet number is transmitted to the microprocessor for calculation of proper postage when depressing the input key 7341.

Figure 15:
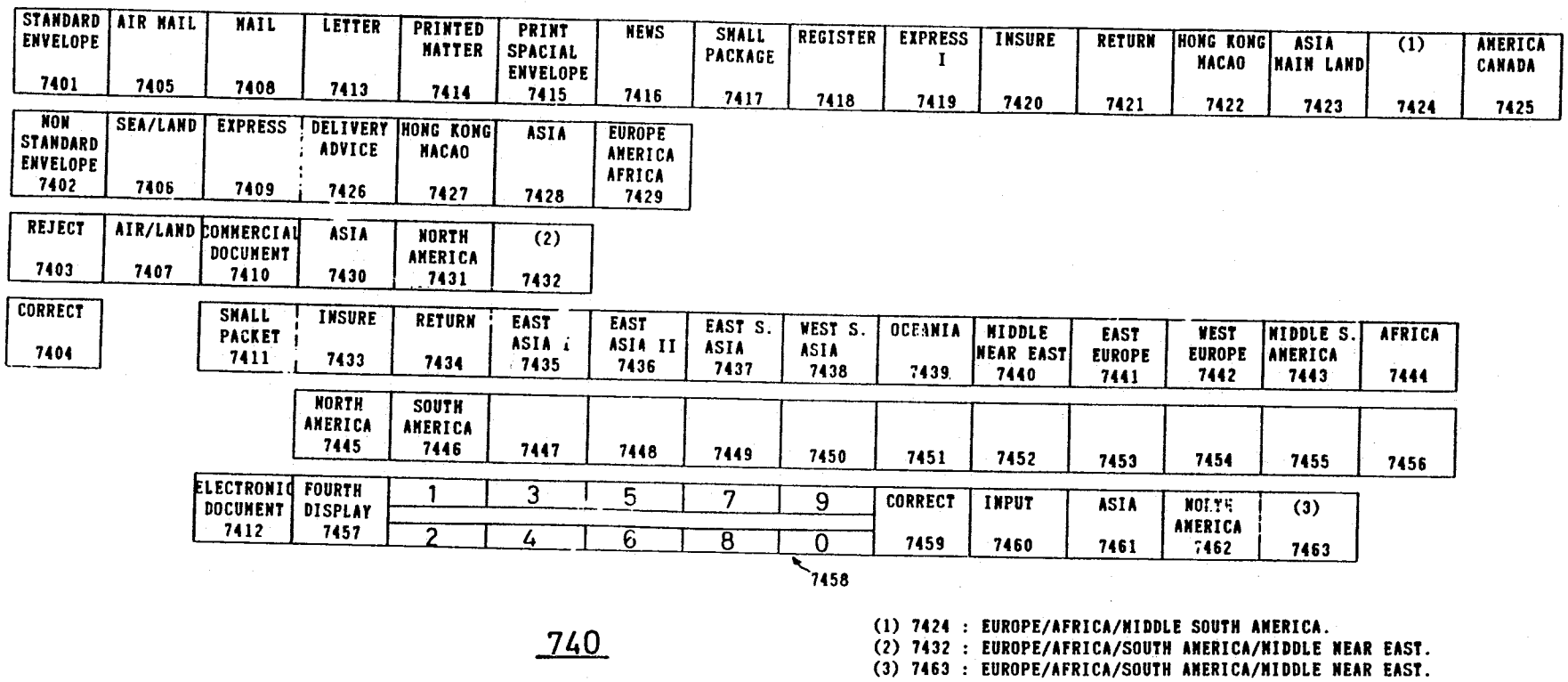
FIG. 15 shows the international key board arrangement according to FIG. 10.

3. The international mail key board 740, as shown in FIG. 15, includes all international mail command inputs, wherein most thereof are identical to the domestic key board 730, but the following keys are added to or changed in the sorting key of the mail key 7408: a print material special envelope key 7415, news key 7416, Hong Kong/Macao key 7422, Asia Main Land key 7423, Europe/Africa/-Central South America key 7424 and America/-Canada key 7425. Moreover, on the sorting key of the express key 7409 are alternatively arranged a delivery advice key 7426, Hong Kong/Macao key 7427, Asia key 7428, and Europe/America/Africa key 7429. On the sorting key of the commercial document key 7410 are alternatively arranged Asia key, etc. 7430 to 7432, and on the sorting key of the small package key 7411 are additionally arranged input keys 7433 to 7446 of areas of East Asia I, East Asia II, East South Asia, West South Asia, Oceania, Middle Near East, East Europe, West Europe, Middle South America, Africa, North America, South Africa, etc. Similarly, on the electronic mail key 7412 are additionally arranged input keys 7461 to 7463 of areas of Asia, North America, Europe/Africa/South America/Middle Near East, etc. The operation manner and use object of the above keys are identical to the precedingly described internal key group 730, and the description thereof is therefore omitted.

4. The bulk mail amount command input key board 750, as shown in FIG. 10, includes bulk mail key 751, numeral key group (consist of 0 to 9 ten numeral keys) and correcting key 753. When mailing bulk mails, the bulk mail key 751 and numeral key group 752 are depressed. The correcting key 753 performs the same function as that described above.

5. The power switch 760 is the main power switch of the present invention, and a lock set can be disposed thereon for security.

6. The actuating key 770 primarily performs the function that when all the inputs are accomplished by the keys on the operation panel, the actuating key 770 is depressed to enable the other portions of the present invention to practice the weighing, postage calculation, postage stamping, money receiving, receipt or certificate printing, datum storage, etc.

7. As described above and shown in FIGS. 1 and 2, the microprocessor is the operation center of the present invention, wherein the CPU and EPROM thereof are provided with programs recording the required postage table, postage calculation manner, sorting of delivery area and postage calculation, managing manner of bulk mail, sheet-counting charged mail calculation manner, receipt and income list and inner/outer operation manner in advance, whereby via the key board system 70, the operation, control, check, calculation, judgement, analysis, execution, performance, datum storage, printing, etc. of the present invention can all be practiced conveniently. Therefore, the present invention can serve as a completely intelligent automatic mail-processing system with full functions.

To best understand the aforesaid functions of the present invention, an example is set forth as follows:

If a mailer wants to send an insured express air mail with standard envelope to France, when the mailer passes the mail to a postal clerk, as shown in FIGS. 10 and 15, the clerk can depress the standard mail key 7401 on the international key board 740, the air mail key 7405 thereof, mail key 7408, express key 7419, insure key 7420, and Europe/Africa/Middle South America key 7424 thereof, and then depress actuating key 770 to complete the command input. At this time, the mail L will be automatically conveyed to the weighing are a by the automatic conveying device 30 (see FIGS. 4, 5, and 13). When the mail L reaches the sensor S4 located at weighing area, the movable stand 200 of the automatic weighing device 23 descends under commands from microprocessor 10 to set the mail L on the weighing plate 501 of the first weighing scale 500 (see FIG. 5). The mail is thereafter weighed by the first weighing scale 500 without contacting any other portion. After weighing, the movable stand 200 of the weighing device 23 automatically returns to its home position to lift the mail L to original level (as shown in FIG. 4). In the meanwhile, the postage, being accurately calculated by microprocessor, is displayed on display device 720, 720A to show the mailer the proper postage. If the mailer want to pay the postage with money card, he can insert the money card into card reader/writer 711. The balance is then displayed, and the postage is substracted therefrom. A new balance is thereafter written on the card by card reader/writer 711. The card is then rejected therefrom. If the last balance can not pay the postage, the card will be rejected from the card reader/-writer after the balance is totally substracted. The mailer then can depress the holding key 712 and insert a new money card. If the mailer wants to pay the due postage in cash, the postal clerk can depress cask key 714 after receiving the money to complete the postage payment procedure.

In the meantime, when the mail L is conveyed to postage stamping area by conveying device 30 as shown in FIG. 9, the mail L will be further sent into the stamping area by rollers 2514, 2512 of the postage stamp device 25. When the mail is detected by the sensors thereof, the numeral wheels 271 thereof (see FIG. 7) are set to proper postage and date positions according to commands from the microprocessor. When the mail L reaches a predetermined position, the printing head 27 is rotated to imprint the set postage and date marks thereon, and the mail-processing operation is then accomplished. The receipt printers 781, 782 of the printer assembly 780 will automatically print the receipts and certificate, and the relevant data are stored in the microprocessor. Additionally, an income list will be printed regularly.

Please now further refer to FIG. 10. Another example is set forth for further understanding the operations of the present invention. Supposing a mailer wants to mail an air small packet to the United States, since the small packet is not standard mail, and can not be stamped with postage stamp directly, a postage label is necessary to be attached to the small packet. Therefore, when managing the small packet, it must be first placed on the second weighing scale 500A to show its weight on the display devices 720, 720A. Thereafter, the necessary commands are input into the microprocessor via key board system 70. Referring to the international key board 740 as shown in FIG. 15, the non standard mail key 7402, air mail key 7405, small packet key 7411 and North America 7445 thereof are depressed, and in case of additional services, the insure key 7433 of the additional service key board is depressed. Consequently, the due postage is immediately displayed on the first and second display devices 720, 720A. The other procedures are identical to the aforesaid ones except that the postage label is supplied by postage label supply device 60 of the postage stamp device 25 as shown in FIG. 13. After imprinted with postage stamp, the postage label is sent out of the rear end of the postage stamp device 25 to the collecting tank 21. The postal clerk then can attach the label to the air small packet. Simultaneously, the receipt printer 781 will send out a double receipt wherein the lower two sheets together with the postage label attached to the small packet while the lower sheet of the upper two sheets is given to the mailer and the upper sheet thereof is attached to a check record of the clerk for later inquiry.

It is to be understood that the domestic and international mail key boards 730 and 740 mentioned above are designed on the requirement of the Post Office of the Rep. of China, and the other similar key boards may be further defined by those skilled in the art in accordance with the different requirement of the Post Office on the basis of each individual country under the spirit of the present invention mentioned above.

As various possible embodiments might be made of the above invention without departing from the scope thereof,it is to be understood that all matter herein described or shown in the accompanying drawings is to be interpreted merely as illustrative, and not in a limiting sense.

I claim:

1. An automatic mail-processing device with full functions, comprising:

a main body having an entrance capable of receiving standard and non-standard;

a microprocessor mounted on said main body, including a microprocessor main control unit, a display I/F circuit, a keyboard system I/F circuit, a conveying device I/F circuit and a postage stamping device I/F circuit;

a conveying device operatively connected to said microprocessor via said conveying device I/F circuit for conveying a mail;

a display device mounted on said main body and operatively connected to said microprocessor via said display I/F circuit for displaying the weight of and postage due for a mail;

a keyboard system operatively connected to said microprocessor via said keyboard system I/F circuit, having all input keys required in mail-processing operation for inputting relevant data of a mail to said microprocessor; and an automatic postage stamping device operatively connected to said microprocessor via said postage stamping device I/F circuit, having postage numeral wheels and date numeral wheels for stamping a mail, whereby when mailing a mail, the mail is first weighed by an external weighing scale, and then the weight and relevant data are input to said microprocessor via said keyboard system, said display device displaying weight and due postage to indicate a mailer to pay the postage whereby when the postage is paid up, in case of a general standard mail, the mail is entered into said main body through said entrance thereof, and thereafter said conveying device conveys said mail to said postage stamping device whereby said microprocessor commands said postage stamping device to arrange said numeral wheels into required postage and date positions and imprint the postage and date marks on the mail, the imprinted mail being released from said postage stamping device by said conveying device to complete a mail-processing operation.

2. A device for the automatic processing of a standard mail with full functions, comprising:

a main body including an entrance for receiving the mail and a first sensor means for sensing the mail;

a microprocessor contained in said main body for controlling said apparatus;

a display device mounted on said main body and operatively connected to said microprocessor for communicating with the mailer, said display device including means for displaying weight of and postage due for the mail;

a keyboard system operatively connected to said microprocessor for inputting relevant data of the mail thereto;

an automatic conveying means operatively connected to said microprocessor for conveying the mail from said entrance when said mail is sensed by said first sensor to a weighing area and to a stamping area;

an automatic weighing device for weighing the mail, said automatic weighing device being located in said weighing area and operatively connected to said microprocessor and including a weighing means and a movable stand, said stand including means for descending whereby the mail is weighed by said weighing means without contacting any other portion of said weighing device, whereupon the postage due is calculated by said microprocessor and displayed on said display device, whereupon when said postage due is paid by said mailer, said microprocessor commands said movable stand to return to its home position, whereupon the mail is further conveyed to said stamping area;

a settable automatic postage stamping device for stamping a mail, said postage stamping device being located at said stamping area and operatively connected to said microprocessor, said stamping device including postage numeral wheels and date numeral wheels, said postage stamping device being responsive to commands from said microprocessor to arrange said numeral wheels whereby the mail is carried by a set of rollers and simultaneously imprinted with a postage stamp including postage and date by said postage stamping device.

3. A device for the automatic processing of a non-standard mail with full functions, comprising:

a main body including an upper face;

a microprocessor contained in said main body for controlling said apparatus;

a display device mounted on said main body and operatively connected to said microprocessor for communicating with the mailer, said display device including means for displaying weight of and postage due for the mail;

a keyboard system operatively connected to said microprocessor for inputting relevant data of the mail thereto;

a weighing device operatively connected to said microprocessor for weighing the mail, said weighing device including a weighing stand forming a part of said mail body upper face;

a postage label supply device operatively connected to said microprocessor for supplying a blank postage label;

a settable automatic postage stamping device operatively connected to said microprocessor for stamping said blank postage label;

an automatic conveying device operatively connected to said microprocessor for conveying said blank postage label from said postage label supply device to said postage stamping device for imprinting postage and date marks on the blank postage label;

wherein said stamping device includes postage numeral wheels and date numeral wheels, said postage stamping device being responsive to commands from said microprocessor to command said numeral wheels to rotate to imprint the label with postage and date marks; and said postage stamping device includes an area from which said postage label is released after having been imprinted by said postage stamping device.

4. A device for the automatic processing of mail with full functions, comprising:

a main body;

a microprocessor contained in said main body for controlling said apparatus;

a display device mounted on said main body and operatively connected to said microprocessor for communicating with the mailer, said display device including means for displaying user fee due for the mail;

a keyboard system operatively connected to said microprocessor for inputting relevant data of the mail thereto;

a facsimile operatively connected to said microprocessor for transmitting an electronic mail;

a printer assembly operatively connected to said microprocessor for printing a receipt;

a money receiver mounted on said main body and operatively connected to said microprocessor for receiving said user fee due from a mailer;

whereupon when relevant data of the mail is input via said keyboard system, said microprocessor computes and displays on said display device the user fee due, whereupon when said user fee due is received in said money receiver, said mail is transmitted by said facsimile and said receipt is printed.

5. A device as claimed in claim 1, further comprising a postage label supply device operatively connected to said microprocessor for sending a blank postage label to said postage stamping device, whereby in case of non-standard mail, a signal is sent to said microprocessor from said keyboard system to command said postage label supply device to supply a blank postage label to said postage stamping device to be imprinted with postage and date marks and released therefrom by said conveying device for a mailer to be attached to the mail.

6. A device as claimed in claim 1, further comprising a second display device operatively connected to said microprocessor for enabling a mailer to view a mail-processing operation practiced by a postal clerk.

7. A device as claimed in claim 2, 3 or 1, wherein said keyboard system includes a domestic mail-processing command input and an international mail-processing command input key.

8. A device as claimed in claim 2, 3, 4 or 1, wherein said microprocessor further includes a money receiver I/F circuit said device including a money receiving means connected to said microprocessor for on-line operation.

9. A device as claimed in claim 8, wherein said money receiving means includes a card reader/writer, holding key, accumulating key and cash key.

10. A device as claimed in claim 2, 3 or 1, wherein said keyboard system further includes a bulk mail amount command input keyboard for sending a bulk mail signal to said microprocessor.

11. A device as claimed in claim 4, wherein said printer assembly includes a receipt printer for printing a receipt of user fee and an income list printer for regularly printing an income list automatically or in response to commands received from said microprocessor.

12. A device as claimed in claim 4, wherein said printer assembly is synchronized with said conveying device to print relevant documents.

13. A device as claimed in claim 2, 3, 4 or 1, wherein said microprocessor is operatively connected to a remote host which controls the operation of a plurality of mail-processing devices.

14. A device as claimed in claim 2, wherein said automatic conveying device includes a driving means, a first conveying means, a corresponding first idle wheel, a second conveying means, a corresponding second idle wheel, a third conveying means, a corresponding third idle wheel, a fixed stand, a movable stand under which said weighing means is located, a first sensor located before said first conveying means and a second sensor located after said third conveying means.

15. A device as claimed in claim 14, wherein said movable stand includes a supporting stand with a rectangular opening in a middle portion thereof, at both ends of said opening there being disposed said second and third idle wheels which are in cooperative relationship with said second and third conveying means respectively to convey a mail to be weighed.

16. A device as claimed in claim 14, wherein a pair of front and rear rocking arms are further provided under said movable stand, each of said rocking arms including a movable end pivotally connected to each end of said movable stand, and the other end of each rocking arm is pivoted on a pivot whereby a pair of electromagnetic actuators are connected to a middle portion of said front rocking arm so that when said electromagnetic actuator is activated, said movable end of each said rocking arm is pulled down with said pivot as a fulcrum, and since said movable stand is attached to said movable ends of both said rocking arms, said movable stand descends together therewith to a lower level, permitting a mail placed thereon to be weighed by said weighing means without contacting any other portion, and after weighing, said rocking arms return to their home positions, permitting the mail to be conveyed by said second and third conveying means into said postage stamping area of said postage stamp device.

17. A device as claimed in claim 15, wherein said supporting stand of said conveying device receives commands from said microprocessor to descend and separate from said conveying device, permitting a mail to be placed on said movable stand and weighed by said weighing means without contacting any other portion, and after weighing, said supporting stand returns to its home position automatically.

18. A device as claimed in claim 2, 3, 1, wherein said postage stamping device includes:

a main shaft having a first end and a second end;

a main shaft driving means disposed on said first end of said main shaft for rotating said main shaft through a certain angle;

a main shaft driving means sensor means for detecting the position of said main shaft;

a printing head means disposed on said second end of said main shaft, including a printing head having a plurality of numeral wheel means composed of several numeral wheels;

a numeral wheel driving means for driving said numeral wheels;

a set of first racks engaged with said numeral wheels; and a sensor means for detecting the positions of said numeral wheels.

19. A device as claimed in claim 18, wherein said main shaft is formed with a plurality of axial grooves on which a set of second racks is slidably disposed in a direction perpendicular to the conveying direction of a mail, said second racks being engaged with said first racks, and said main shaft driving means includes a driving motor for rotating said main shaft, a transmitting means and an encoder means for controlling travel of said main shaft wherein said driving motor is engaged with said first end of said main shaft via said transmitting means, whereby when relevant data of a mail are input via said keyboard system, said microprocessor commands a set of driving gears to drive said second racks and control travel of said second racks so as to control, via said first racks, rotation angles of said numeral wheels to set said numeral wheels into required positions whereby when a mail enters a printing area of said postage stamping device, said main shaft driving means is commanded by said microprocessor to rotate said main shaft and said printing head one turn to imprint set postage, date or relevant marks of said numeral wheels on the mail, the mail being further sent to a subsequent processing device thereafter and said numeral wheels being zeroed for next printing cycle.

20. A device as claimed in claim 18, wherein said printing head includes at least one settable numeral wheel means, and said numeral wheel means includes at least two independent numeral wheels, and each said numeral wheel has a gear driven by a corresponding first rack of said first racks disposed outside said main shaft, said corresponding first rack being formed with a hooking arm for engaging with a first end of a corresponding second rack of said second racks.

21. A device as claimed in claim 18, wherein said printing head further includes a separate encoder disposed near said second end of said second rack for controlling travel of said second rack by means of microprocessor control.

22. A device as claimed in claim 18, wherein a relatively smaller diameter portion is formed on said main shaft in alignment with said driving gear for driving said second rack, said smaller diameter portion coming flush with a dented base of said second rack so that when said printing head together with said main shaft are rotated, said relatively smaller diameter portion can slip through said driving gear.

* * * * *

UNITED STATES PATENT AND TRADEMARK OFFICE

CERTIFICATE OF CORRECTION

PATENT NO. : 5,272,640
DATED : December 21, 1993
INVENTOR(S) : Sheng J. Wu

It is certified that error appears in the above-indentified patent and that said Letters Patent is hereby corrected as shown below:

Column 14, claim 1, line 11, after "non-standard" insert -- mail--.
Column 16, claim 7, line 38, after "input" insert -- key --.
Column 17, claim 18, line 1, after "3" insert -- or --.

Signed and Sealed this

Twenty-sixth Day of April, 1994

*Attest:*

Bruce Lehman

BRUCE LEHMAN

*Attesting Officer*

*Commissioner of Patents and Trademarks*